US010156800B2

(12) United States Patent
Tsuda et al.

(10) Patent No.: US 10,156,800 B2
(45) Date of Patent: Dec. 18, 2018

(54) TONER, DEVELOPING DEVICE, AND IMAGE FORMING APPARATUS

(71) Applicant: CANON KABUSHIKI KAISHA, Tokyo (JP)

(72) Inventors: Shohei Tsuda, Suntou-gun (JP); Naoki Okamoto, Mishima (JP); Takashi Matsui, Mishima (JP); Yuujirou Nagashima, Susono (JP); Keisuke Tanaka, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/629,839

(22) Filed: Jun. 22, 2017

(65) Prior Publication Data

US 2018/0004108 A1 Jan. 4, 2018

(30) Foreign Application Priority Data

Jun. 30, 2016 (JP) ..... 2016-130213

(51) Int. Cl.

| | |
|---|---|
| ***G03G 9/087*** | (2006.01) |
| ***G03G 9/08*** | (2006.01) |
| ***G03G 9/09*** | (2006.01) |
| ***G03G 15/08*** | (2006.01) |
| ***G03G 21/00*** | (2006.01) |
| *G03G 15/09* | (2006.01) |

(52) U.S. Cl.

CPC ..... *G03G 9/08711* (2013.01); *G03G 9/0819* (2013.01); *G03G 9/0821* (2013.01); *G03G 9/0825* (2013.01); *G03G 9/08755* (2013.01); *G03G 9/08795* (2013.01); *G03G 9/08797* (2013.01); *G03G 9/091* (2013.01); *G03G 9/0904* (2013.01); *G03G 15/0808* (2013.01); *G03G 21/0064* (2013.01); *G03G 15/09* (2013.01)

(58) Field of Classification Search

CPC ..... G03G 9/0825; G03G 9/08711; G03G 9/0821; G03G 9/08755; G03G 9/0819

USPC ..... 430/110.1

See application file for complete search history.

(56) References Cited

U.S. PATENT DOCUMENTS

| | | | |
|---|---|---|---|
| 4,657,838 | A | 4/1987 | Fukumoto et al. |
| 4,673,631 | A | 6/1987 | Fukumoto et al. |
| 4,710,443 | A | 12/1987 | Tanaka et al. |
| 4,737,432 | A | 4/1988 | Tanaka et al. |
| 4,839,255 | A | 6/1989 | Hyosu et al. |
| 4,886,725 | A | 12/1989 | Tanaka et al. |
| 5,071,727 | A | 12/1991 | Ikeda et al. |
| 5,288,579 | A | 2/1994 | Tanaka et al. |
| 5,306,588 | A | 4/1994 | Tanaka et al. |
| 5,356,749 | A | 10/1994 | Hagiwara et al. |
| 5,508,139 | A | 4/1996 | Tanaka et al. |
| 7,361,400 | B2 | 4/2008 | Shimamura et al. |
| 7,396,626 | B2 | 7/2008 | Fujikawa et al. |
| 7,396,629 | B2 | 7/2008 | Baba et al. |
| 7,611,813 | B2 | 11/2009 | Ida et al. |
| 7,629,100 | B2 | 12/2009 | Okamoto et al. |
| 7,678,523 | B2 | 3/2010 | Hiroko et al. |
| 7,842,446 | B2 | 11/2010 | Yanase et al. |
| 7,923,190 | B2 | 4/2011 | Magome et al. |
| 7,935,467 | B2 | 5/2011 | Dojo et al. |
| 8,114,562 | B2 | 2/2012 | Ishigami et al. |
| 8,298,742 | B2 | 10/2012 | Okamoto et al. |
| 8,426,091 | B2 | 4/2013 | Magome et al. |
| 8,426,094 | B2 | 4/2013 | Magome et al. |
| 8,614,044 | B2 | 12/2013 | Matsui et al. |
| 8,778,585 | B2 | 7/2014 | Matsui et al. |
| 8,841,054 | B2 | 9/2014 | Dojo et al. |
| 8,883,389 | B2 | 11/2014 | Matsui et al. |
| 8,945,805 | B2 | 2/2015 | Baba et al. |
| 9,034,551 | B2 | 5/2015 | Endo et al. |
| 9,046,800 | B2 | 6/2015 | Hotta et al. |
| 9,097,997 | B2 | 8/2015 | Nomura et al. |
| 9,213,250 | B2 | 12/2015 | Nomura et al. |
| 9,213,251 | B2 | 12/2015 | Ohmori et al. |
| 9,217,943 | B2 | 12/2015 | Matsui et al. |
| 9,235,151 | B2 | 1/2016 | Tanaka et al. |
| 9,239,528 | B2 | 1/2016 | Hasegawa et al. |

(Continued)

FOREIGN PATENT DOCUMENTS

| | | | |
|---|---|---|---|
| JP | 2004-295105 A | | 10/2004 |
| JP | 2011-145587 A | | 7/2011 |
| JP | 2018-010288 A | * | 1/2018 |

OTHER PUBLICATIONS

ESPACENET machine-assisted English-language translation of Japanese Patent 2018-010288 A (pub. Jan. 2018).*

(Continued)

*Primary Examiner* — Janis L Dote

(74) *Attorney, Agent, or Firm* — Fitzpatrick Cella Harper and Scinto

(57) ABSTRACT

Provided is a toner comprising a toner particle including a binder resin, an amorphous polyester, and a colorant, wherein the binder resin includes a vinyl resin, the toner has a softening point of at least 110° C. and not more than 140° C., an amount of the amorphous polyester is at least 4.0 parts by mass and not more than 30.0 parts by mass with respect to 100 parts by mass of the binder resin, and a temperature T at which an area increasing rate of one toner particle sample becomes 1.40, is not more than 110° C., and a slope of the area increasing rate with respect to a temperature in the range of the area increasing rate of 1.40 to 2.00 is not more than 0.07.

12 Claims, 3 Drawing Sheets

(56) References Cited

U.S. PATENT DOCUMENTS

| | | | |
|---|---|---|---|
| 9,261,806 | B2 | 2/2016 | Moribe et al. |
| 9,285,697 | B2 | 3/2016 | Fukudome et al. |
| 9,304,422 | B2 | 4/2016 | Matsui et al. |
| 9,348,246 | B2 | 5/2016 | Magome et al. |
| 9,354,545 | B2 | 5/2016 | Matsui et al. |
| 9,442,416 | B2 | 9/2016 | Magome et al. |
| 9,442,419 | B2 | 9/2016 | Wakabayashi et al. |
| 9,470,993 | B2 | 10/2016 | Nishikawa et al. |
| 9,575,425 | B2 | 2/2017 | Naka et al. |
| 9,581,934 | B2 | 2/2017 | Ito et al. |
| 9,588,450 | B2 | 3/2017 | Tsuda et al. |
| 9,606,462 | B2 | 3/2017 | Nomura et al. |
| 9,658,546 | B2 | 5/2017 | Tanaka et al. |
| 9,715,188 | B2 | 7/2017 | Terauchi et al. |
| 2009/0197192 | A1 | 8/2009 | Hiroko et al. |
| 2015/0125790 | A1 | 5/2015 | Hotta et al. |
| 2015/0185658 | A1 | 7/2015 | Wakabayashi et al. |
| 2015/0227067 | A1 | 8/2015 | Hasegawa et al. |
| 2015/0227068 | A1 | 8/2015 | Sano et al. |
| 2015/0227069 | A1 | 8/2015 | Sugama et al. |
| 2016/0041482 | A1 | 2/2016 | Terauchi et al. |
| 2016/0041484 | A1 | 2/2016 | Tsuda et al. |
| 2016/0139521 | A1 | 5/2016 | Tsuda et al. |
| 2016/0266509 | A1 | 9/2016 | Sano et al. |
| 2016/0378003 | A1 | 12/2016 | Arimura et al. |
| 2017/0123333 | A1 | 5/2017 | Kuroki et al. |
| 2017/0160660 | A1 | 6/2017 | Hasegawa et al. |
| 2017/0160661 | A1 | 6/2017 | Suzumura et al. |
| 2017/0160662 | A1 | 6/2017 | Nagashima et al. |
| 2018/0004109 | A1* | 1/2018 | Matsui ..... G03G 9/08797 |

OTHER PUBLICATIONS

U.S. Appl. No. 15/259,114, filed Sep. 8, 2016, Yoshitaka Suzumura.
U.S. Appl. No. 15/416,055, filed Jan. 26, 2017, Takashi Matsui.
U.S. Appl. No. 15/631,186, filed Jun. 23, 2017, Takashi Matsui.
U.S. Appl. No. 15/631,366, filed Jun. 23, 2017, Takashi Matsui.

* cited by examiner

TONER, DEVELOPING DEVICE, AND IMAGE FORMING APPARATUS

BACKGROUND OF THE INVENTION

Field of the Invention

The present invention relates to a toner, a developing device, and an image forming apparatus for use in electrophotography and an image forming method for visualizing an electrostatic charge image.

Description of the Related Art

In recent years, the way in which copying machines and printers are used has changed from "one machine for a plurality of people" to "one machine for one person". Accordingly, further reduction in size needs to be achieved while ensuring a long life and high image quality. In this regard, it is effective to reduce the size of a process cartridge in which a developer is stored and to reduce the size of a fixing device mounted on a main body. One of effective means for reducing the size of the process cartridge is the use of a cleanerless system. Since the cleanerless system does not have a cleaning blade or waste toner box, it can greatly contribute to the size reduction of the main body.

In the cleanerless system, the toner remaining on an electrostatic latent image bearing member after the transfer is collected by a toner carrying member in the developing device and sent to a developing step again. As compared with a configuration having a cleaning blade, the stress applied to the toner is increased, and cracking or crushing of the toner particle may occur.

The occurrence of cracking and crushing of the toner particle is significant particularly when the members such as a toner carrying member and a regulating blade become hard under a low-temperature and low-humidity environment. In this case, the particle size distribution is widened and rubbing between the toner carrying member and the blade is unlikely to produce sufficient charging. As a result, the so-called fogging, that is a phenomenon in which a toner having a low charge quantity is developed in a non-image area on the electrostatic latent image bearing member, is likely to occur. In order to suppress such a fogging phenomenon, it is necessary to improve further the brittleness of toner particles.

The reduction in size of the fixing device mounted on the main body is considered to be another effective means for reducing a printer in size.

In the case of film fixing, simplification of a heat source and device configuration is easy and can be readily applied to reduce the fixing device in size. However, since film fixing generally uses a small amount of heat and a light pressure, heat may not be sufficiently transferred to the toner. Also, in recent years, printers are often used under various environments all over the world, and particularly under a room-temperature and high-humidity environment, heat is consumed by moisture and the amount of heat given to the toner is further reduced.

Under these conditions, when a solid image is printed, sufficient heat is not transferred to the toner, the toner is hardly melted, and the adhesion between the paper and the toner or between the toner particles is deteriorated. As a result, an image defect (referred to hereinbelow as "white spots") occurs in which a part of the solid image blurs out white. Where the melt viscosity of the toner is lowered to solve this problem, the toner particles are cracked or crushed as described above, or density unevenness of the fixed image is likely to occur, in particular, when paper having low smoothness is used.

Therefore, in film fixing, a toner that can be fixed with a small amount of heat and light pressure becomes necessary.

It follows from the above that it is appropriate to use a cleanerless system and film fixing to reduce the printer in size. For that purpose, a toner that can be fixed with a small amount of heat and light pressure, while suppressing cracking and crushing of the toner particle under a low-temperature and low-humidity environment is required, and various methods for improving toners have been suggested to solve these problems.

In Japanese Patent Application Publication No. 2004-295105, both charging stability and fixing performance are achieved by using a toner in which a styrene acrylic resin and a polyester resin are dispersed at a micro level.

Further, Japanese Patent Application Publication No. 2011-145587 discloses many examples in which both development stability and fixing performance are achieved by finely dispersing a crystalline resin having a toner plasticizing effect in the toner.

Japanese Patent Application Publication No. 2015-152703 describes a toner in which a toner particle includes a binder resin containing an amorphous resin (A) and an amorphous polyester resin (B), and a colorant, wherein the amorphous polyester resin (B) is dispersed as a domain phase in a matrix phase including the amorphous resin (A). It is indicated that a number average domain diameter has a value within a specific range in an observation image of the toner particle cross section.

SUMMARY OF THE INVENTION

However, in Japanese Patent Application Publication No. 2004-295105, where the polyester resin and the styrene acrylic resin are dispersed to the surface of the toner, an external additive may be embedded in the polyester resin portion or the toner particles may be cracked and chipped when a cleanerless system is used.

Further, where the technique disclosed in Japanese Patent Application Publication No. 2011-145587 is used in a cleanerless system in which unconventionally larger stress is applied, the stress resistance of the toner may be insufficient. Furthermore, where paper with low smoothness is used, density unevenness may occur due to melting of the entire toner during fixing.

Concerning Japanese Patent Application Publication No. 2015-152703, the results of the investigation conducted by the inventors of the present invention have indicated that where a cleanerless system is used, cracking and chipping of the toner particle can occur, and if paper having low smoothness is used, density unevenness can occur in some cases.

It follows from the above that there is still room for improvement when considering the use of a cleanerless system and film fixing for size reduction.

An objective of the present invention is to provide a toner which solves the above problems.

Thus, an objective of the present invention is to provide a toner which makes it possible to obtain satisfactory fogging characteristic over a long period of use under a low-temperature and low-humidity environment and at the same time to suppress white spots and density unevenness in the fixed image even under a normal-temperature and high-humidity environment. It is also an objective of the present invention to provide a developing device and an image forming apparatus having the toner.

Thus, provided is a toner comprising toner particles each of which includes a binder resin, an amorphous polyester, and a colorant, wherein the binder resin includes a vinyl resin, the toner has a softening point of at least 110° C. and not more than 140° C., an amount of the amorphous polyester is at least 4.0 parts by mass and not more than 30.0 parts by mass with respect to 100 parts by mass of the binder resin, and wherein when observing the toner which is sandwiched with a pair of cover glasses while heating the cover glasses from 40° C. to 160° C. at a temperature increasing rate of 1.5° C./sec., and defining an area of one of the toner particles at the temperature of 40° C. as 1, a temperature T at which an area increasing rate becomes 1.40, is not more than 110° C., and a slope of the area increasing rate with respect to a temperature in the range of the area increasing rate of 1.40 to 2.00 is not more than 0.07.

The present invention also provides a developing device including a toner for developing an electrostatic latent image formed on an electrostatic latent image bearing member; and a toner carrying member that carries the toner and transports the toner to the electrostatic latent image bearing member, wherein the toner is the abovementioned toner.

Furthermore, the present invention provides an image forming apparatus including: an electrostatic latent image bearing member; a charging member that charges the electrostatic latent image bearing member; a toner for developing an electrostatic latent image formed on the electrostatic latent image bearing member; and a toner carrying member that comes into contact with the electrostatic latent image bearing member and transports the toner, the toner which remains on the electrostatic latent image bearing member after a transfer being collected by the toner carrying member, wherein the toner is the abovementioned toner.

In accordance with the present invention, a toner can be obtained which makes it possible to obtain satisfactory fogging characteristic over a long period of use under a low-temperature and low-humidity environment and at the same time excels in low-temperature fixability and enables the suppression of density unevenness in the fixed image. Further, in accordance with the present invention, it is also possible to provide a developing device and an image forming apparatus having the toner.

Further features of the present invention will become apparent from the following description of exemplary embodiments (with reference to the attached drawings).

DESCRIPTION OF THE EMBODIMENTS

Figure 1:
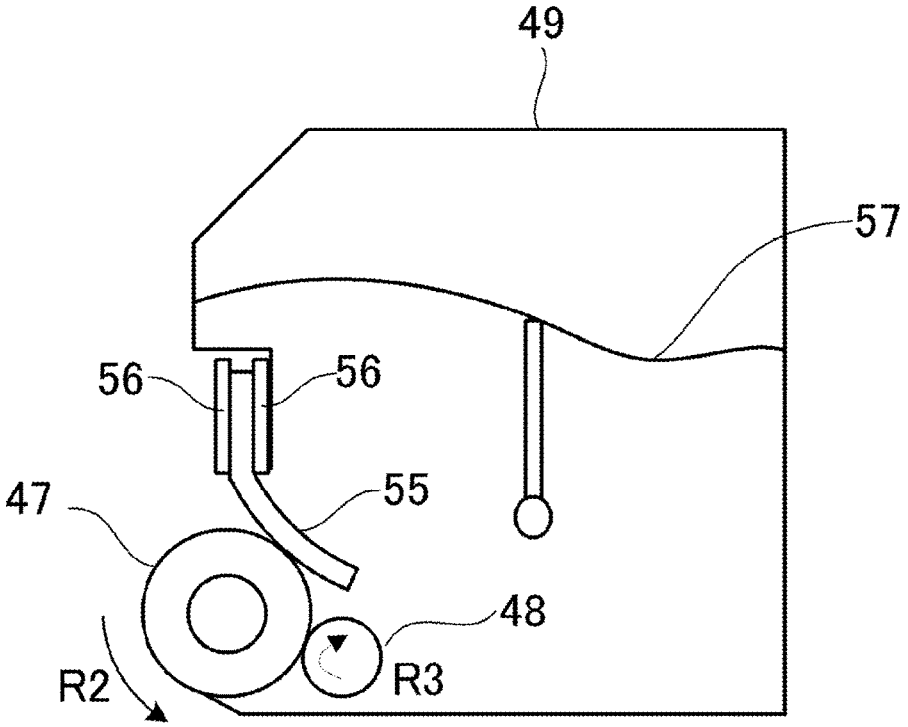
FIG. 1 shows an example of a developing device.

In the present invention, the expression "at least A and not more than B" or "A to B" representing the numerical range means a numerical range including a lower limit and an upper limit which are endpoints, unless specified otherwise.

As described above, the use of a cleanerless system and film fixing is suitable for size reduction of printers which has been required in recent years.

First of all, when considering the cleanerless system, the number of times the toner carrying member rubs against the regulating blade is increased, and toner deterioration is advanced. Thus, cracking and crushing of the toner particle occurs, the particle size distribution becomes wide, and it becomes difficult to perform sufficient charging by rubbing between the toner carrying member and the blade. As a result, fogging phenomenon in which a toner having a low charge quantity is developed in a non-image area (white image portion) on the electrostatic latent image bearing member is likely to occur.

The investigation conducted by the inventors of the present invention has demonstrated that fogging caused by cracking or crushing of the toner particle is particularly significant under a low-temperature and low-humidity environment. This is apparently because under such environment, stress is likely to be applied to the toner due to increase in the member hardness of the charging roller, toner carrying member, regulating blade, or the like.

Therefore, increasing the hardness of the toner particle is a necessary condition for suppressing cracking and crushing of the toner particle.

Meanwhile, considering the application of film fixing, it is necessary that the toner be fixable with a light pressure and a smaller amount of heat. Under these conditions, when the amount of applied toner on paper becomes large, for example, in the case of a full-surface solid image, part of the image after fixing becomes white, that is, "white spots" occur, and these are more likely to occur under a normal-temperature and high-humidity environment.

The investigation conducted by the inventors of the present invention has demonstrated that the toner fixed on the paper in the form of a solid image is fixed in a state in which only the surface of particles is melted to form a continuous configuration, while agglomerates remain intact, and the toner particles are surface bonded to each other. Thus, it was found that the white spots represent a phenomenon resulting from insufficient melt spreading caused by surface melting of the toner particles and from insufficient adhesion between the toner particles. In particular, under a normal-temperature and high-humidity environment, heat on the fixing film is consumed by moisture contained on the paper, and the amount of heat given to the toner is further reduced, so that surface melting of the toner particles becomes even more insufficient and white spots are more likely to occur.

Therefore, as a necessary condition for suppressing white spots, it is required that the toner melt and spread at a lower temperature and the adhesion between the toner particles and the toner particles be improved.

Where the melt viscosity of the toner particles is simply lowered to improve melt spreading of the toner, cracking or crushing of the toner particle occurs and density unevenness of the fixed image is likely to occur.

The investigation conducted by the inventors of the present invention has demonstrated that this density unevenness is unevenness in melting of the toner particles arranged on the paper, and also that such unevenness becomes more significant when the melt viscosity of the toner particles is low. This is because where the melting temperature of the toner particle is too low when the particle passes over the fixing film, the unevenness of the paper is likely to be picked up and also more likely to be recognized as image unevenness. Therefore, as a necessary condition for resolving the problem of density unevenness, it is required that the melt uniformity of the toner particle layer be high and that the melt viscosity of the toner particles be controlled.

When the melting of the toner particles is uneven, since the toner particle exhibits a large deformation amount as the film temperature rises, the manner in which toner particles forming an image are melted is likely to become nonuniform. Therefore, in order to increase the melt uniformity, it is necessary that the melt deformation amount of the toner particles be insensitive to the temperature.

A core-shell type toner particle has been suggested as an approach for maintaining low-temperature fixability while increasing the hardness of the toner particles.

The core-shell type toner particle is formed with a structure which has a material with a high softening point in the shell portion and a plasticizer such as a material with a low softening point or a release agent in the core portion. However, when such a particle is used for a long period of time in an image forming apparatus in which a stress is likely to be applied to the toner, as in a cleanerless system, the core portion is soft even when a material with a high softening point is present in the shell. Therefore, the deterioration of the toner, such as cracking of the toner particle, is difficult to prevent. Further, where attention is paid to white spots, since a material with a high softening point is used for the shell portion, melt spreading at a lower temperature cannot be expected and surface melting is unlikely to be advanced.

As described above, when reducing the size of the apparatus main body by using the cleanerless system and film fixing, it is difficult to advance the surface melting and also to control the melt viscosity and melt deformation amount of the toner particle with respect to heat while increasing the hardness of the toner particle.

The results of the further detailed investigation conducted by the inventors of the present invention have demonstrated that in order to suppress white spots and density unevenness in film fixing under a normal-temperature and high-humidity environment while suppressing cracking and crushing of the toner particle under a low-temperature and low-humidity environment, the following conditions need to be satisfied.

Thus, a toner having a toner particle including a binder resin, an amorphous polyester, and a colorant, wherein the binder resin includes a vinyl resin, the toner has a softening point of at least 110° C. and not more than 140° C., an amount of the amorphous polyester is at least 4.0 parts by mass and not more than 30.0 parts by mass with respect to 100 parts by mass of the binder resin, and a temperature T at which an area increasing rate of one toner particle sample becomes 1.40, is not more than 110° C., and a slope of the area increasing rate with respect to a temperature in the range of the area increasing rate of 1.40 to 2.00 is not more than 0.07, when sandwiching the toner between cover glasses, putting the cover glasses which have sandwiched the toner on a heating stage, observing the toner from above while heating the cover glasses which have sandwiched the toner from 40° C. to 160° C. at a rate of 1.5° C./sec, and defining an area S(40) of the one toner particle sample at 40° C. as 1.

The present invention will be described hereinbelow in detail.

First, the toner of the present invention includes a toner particle including a binder resin, an amorphous polyester, and a colorant, the binder resin including a vinyl resin.

As a result of including the vinyl resin, for example, it is easy to maintain the rigidity and viscosity of the toner, and cracking and crushing of the toner particle can be suppressed. With the amorphous polyester, for example, it is possible to introduce a moiety which melts in a specific temperature range, and it is easy to suppress white spots. Further, as described hereinbelow, the softening point of the toner can be controlled by the proportion at which the vinyl resin and the amorphous polyester are present in the toner particle. Further, as described hereinbelow, by controlling the positions where the vinyl resin and the amorphous polyester are present, it is possible to control the melt spreading temperature T and the slope of the area increasing rate.

The toner of the present invention is also characterized by that a temperature T at which the area increasing rate of one toner particle sample becomes 1.40, is not more than 110° C., and the slope of the area increasing rate with respect to temperature in the range of 1.40 to 2.00 is not more than 0.07, when sandwiching the toner between cover glasses, putting the cover glasses which have sandwiched the toner on a heating stage, observing the toner from above while heating the cover glasses which have sandwiched the toner from 40° C. to 160° C. at a rate of 1.5° C./sec, and defining an area S(40) of the one toner particle sample at 40° C. as 1. In order to suppress white spots while maintaining durability and density unevenness, it is preferable to improve the adhesion of the toner particle surface layer. However, the conventional methods of confirming thermal characteristics of the toner, for example, by measuring the softening point or evaluating viscoelastic characteristics, are methods for evaluating the toner as bulk and cannot easily evaluate the toner performance such as white spots and density unevenness which strongly relate to the adhesive characteristics of the surface of one toner particle.

The results of the investigation conducted by the inventors of the present invention have demonstrated that a method for measuring how the area of a toner particle increases due to the melt spreading of the toner when the toner sandwiched between cover glasses is placed on a heating stage and the stage temperature is raised is correlated with the level of white spots and density unevenness.

When a fixed image at a lower limit temperature at which white spots did not occur and a fixed image at an upper limit temperature at which white spots occurred were observed, it was found that where one toner particle melts and spreads to an area which is larger by a factor of 1.40, surfaces of the adjacent toner particles are bonded to each other or the toner and paper are bonded to each other and white spots do not occur. Based on the results of this investigation, it was found that where the attention is focused on the stage temperature at the time the toner particle spreads to an area which is larger by a factor of 1.40 when the toner sandwiched between the cover glasses is placed on a heating stage and the stage temperature is raised, there is a strong correlation with the level of white spots.

Where the temperature T at the time the factor of 1.40 is reached (referred to hereinbelow as "melt spreading temperature") exceeds 110° C., melting of the surface layer of the toner particle becomes insufficient and white spots are likely to occur. In order to set the melt spreading temperature to not more than 110° C., it is important to advance melting in the vicinity of the toner particle surface. In order to advance melting in the vicinity of the toner particle surface, it is preferable to have a resin with a low softening point in the vicinity of the toner particle surface. The melt spreading temperature is preferably not more than 105° C. Meanwhile, the lower limit is not particularly restricted, but is preferably at least 80° C., and more preferably at least 85° C.

Further, the slope of the area increasing rate represents the speed at which one toner particle melts and spreads. The results of the investigation conducted by the inventors of the present invention have demonstrated that when the slope of the area increasing rate is large, that is, when the melt spreading speed increases, since the toner particle exhibits a large deformation amount as the temperature rises, the manner in which toner particles forming an image are melted becomes nonuniform. As a result of further investigations, it was found that the melt nonuniformity of toner particles, which is represented by the slope of the area increasing rate, has strong correlation with density unevenness. Thus, it was found that the slope of the area increasing rate of at least 0.07 is necessary to suppress the density unevenness.

When the area increasing rate exceeds 0.07, since a state is assumed in which the melting of not only the toner particle surface layer but also of the core is promoted, the toner particle exhibits a large deformation amount as the temperature rises. Therefore, paper unevenness is likely to be picked up and the manner in which toner particles forming an image are melted becomes nonuniform. As a result, density unevenness occurs. Further, with such a toner particle configuration, cracking and crushing of the toner particle occur after prolonged use. As a result, fogging is likely to occur in a low-temperature and low-humidity environment. Therefore, in order to obtain the area increasing rate of at least 0.07, it is preferable to have a material with a high softening point in the core portion of the toner particle, or to adjust the amount of THF insolubles in the toner. The area increasing rate is preferably not more than 0.05. Meanwhile, the lower limit thereof is not particularly limited, but is preferably at least 0.02, and more preferably at least 0.03.

Further, the toner of the present invention is characterized by having a softening point of at least 110° C. and not more than 140° C. By controlling the softening point of the toner, it is possible to prevent the excessive melting of the toner on the protrusions of the paper and the insufficient melting of the toner in the depressions of the paper at the same time, thereby reducing density unevenness. Thus, by setting the softening point of the toner to at least 110° C., it is possible to control the excessive melting of the toner on the protrusions, and by setting the temperature to not more than 140° C., it is possible to improve the insufficient melting in the depressions. The softening point is preferably at least 115° C. and not more than 140° C., more preferably at least 120° C. and not more than 140° C., and even more preferably at least 125° C. and not more than 135° C.

When the softening point of the toner is outside the above range, the following effects are also observed.

Where the softening point is lower than 110° C., cracking or crushing of the toner particle under a low-temperature and low-humidity environment or toner deterioration caused by embedding of external additives occurs, and fogging is likely to occur. When the softening point exceeds 140° C., melt spreading becomes slow and adhesion between the toner particles is decreased, so that white spots are likely to occur.

The softening point of the toner can be controlled to an optimum value by adjusting the molecular weight of the resin used in the toner, the amount of THF insolubles used in the toner, and the type and amount of plasticizer such as wax.

By satisfying these requirements, it is possible to obtain a toner in which fogging caused by cracking or crushing of the toner particle under a low-temperature and low-humidity environment can be suppressed through a long-term use, and white spots under a normal-temperature and high-humidity environment can be suppressed while suppressing density unevenness.

Next, the binder resin used in the present invention will be described.

The binder resin of the toner particle includes a vinyl resin. In addition to the vinyl resin, a publicly known resin used as a binder resin may be used to such an extent that the effect of the present invention is not impaired. It is preferable that the binder resin be a vinyl resin.

As described above, a vinyl resin that maintains rigidity and viscosity can be easily designed, and the amorphous polyester can easily introduce a moiety which melts in a specific temperature range. Therefore, in order to suppress cracking and crushing of the toner particle and also suppress white spots and density unevenness, it is preferable to use a toner particle configuration that effectively utilizes the respective features. In other words, from the viewpoint of controllability of the melt spreading temperature, it is preferable to use a material with a low softening point as the amorphous polyester. From the viewpoint of controllability of the slope of the area increasing rate, it is more preferable that the amorphous polyester be present in the vicinity of the toner particle surface and that the vinyl resin be present in the core portion (central portion of the toner particle).

Examples of the vinyl resins are presented below.

Homopolymers of styrene such as polystyrene and polyvinyl toluene, and substitution products thereof;

styrene copolymers such as styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleic acid ester copolymer; and polymethyl methacrylate, polybutyl methacrylate, polyvinyl acetate, polyethylene, polypropylene, polyvinyl butyral, and polyacrylic acid resins may be used, and these may be used singly or in combination of plural kinds. Among them, from the viewpoints of the easiness of controlling the fixing performance and development characteristics, a styrene copolymer, in particular, styrene-butyl acrylate copolymer is preferred.

The amount of the amorphous polyester is at least 4.0 parts by mass and not more than 30.0 parts by mass with respect to 100 parts by mass of the binder resin. It is preferably at least 5.0 parts by mass and not more than 30.0 parts by mass, and more preferably at least 5.0 parts by mass and not more than 20.0 parts by mass. When the amount is at least 4.0 parts by mass, the melt spreading temperature of the toner particle can be easily controlled and white spots can be easily suppressed. Meanwhile, when the amount is not more than 30.0 parts by mass, the slope of the area increasing rate can be easily controlled, which leads to suppression of cracking and crushing of the toner particle over service life and to reduction of density unevenness.

Further, from the viewpoint of increasing the hardness of the toner particle and facilitating the melt spreading control of the toner particle for reducing density unevenness and white spots, it is preferable that the amorphous polyester have a monomer unit derived from an alcohol component and a monomer unit derived from a straight-chain aliphatic dicarboxylic acid having at least 6 and not more than 12 carbon atoms, the monomer unit derived from a straight-chain aliphatic dicarboxylic acid having at least 6 and not more than 12 carbon atoms being included in at least 10 mol % and not more than 50 mol % with respect to all monomer units derived from a carboxylic acid component in the amorphous polyester.

As described above, in order to control the melt spreading temperature, it is preferable that the amorphous polyester be a material with a low softening point. A preferred method therefor is to include a moiety derived from a straight-chain aliphatic dicarboxylic acid having at least 6 and not more than 12 carbon atoms into the amorphous polyester. As a result, the softening point of the amorphous polyester is likely to be lowered in a state in which the peak molecular weight of the amorphous polyester is increased. Therefore, the melt spreading temperature and the slope of the area increasing rate are easily controlled while suppressing cracking and crushing of the toner particle.

Further, a straight-chain aliphatic dicarboxylic acid having at least 6 and not more than 12 carbon atoms enables instantaneous melting at the time of fixing, so that the melt spreading temperature is likely to be lowered. As a result, adhesion is likely to occur between the toner particles, and white spots can be easily reduced. The inventors of the present invention presume that this is because the straight-chain aliphatic dicarboxylic acid moiety folds, presumably facilitating the formation of an amorphous polyester structure like a pseudo-crystalline state.

When the number of carbon atoms of the straight-chain aliphatic dicarboxylic acid is at least 6, the straight-chain aliphatic dicarboxylic acid moiety is easily folded, thereby facilitating the formation of a structure like a pseudo-crystalline state. As a result, instantaneous melting at the time of fixing is enabled. Therefore, the adhesion between the toner particles caused by a decrease in the melt spreading temperature is likely to occur. When the number of carbon atoms of the straight-chain aliphatic dicarboxylic acid is not more than 12, the softening point and the peak molecular weight can be easily controlled. Therefore, the hardness of the toner particle can be easily increased and the melt spreading temperature can be easily controlled. The number of carbon atoms is more preferably at least 6 and not more than 10.

It is preferable that the amount of the monomer unit derived from the straight-chain aliphatic dicarboxylic acid be at least 10 mol % because the softening point is likely to decrease. Further, when the amount of the monomer unit derived from the straight-chain aliphatic dicarboxylic acid is not more than 50 mol %, it is difficult to reduce the peak molecular weight of the amorphous polyester and, therefore, cracking and crushing of the toner particle can be easily controlled. The amount of the unit derived from the straight-chain aliphatic dicarboxylic acid is more preferably at least 30 mol % and not more than 50 mol %. The term "monomer unit" refers to a reacted form of a monomer substance in the polymer.

Examples of the carboxylic acid component for obtaining the amorphous polyester of the present invention include straight-chain aliphatic dicarboxylic acids having at least 6 and not more than 12 carbon atoms and other carboxylic acids. Examples of the straight-chain aliphatic dicarboxylic acids having at least 6 and not more than 12 carbon atoms include adipic acid, suberic acid, sebacic acid, and dodecanedioic acid. Examples of the carboxylic acids other than the straight-chain aliphatic dicarboxylic acids having at least 6 and not more than 12 carbon atoms are presented below.

Examples of divalent carboxylic acid components include maleic acid, fumaric acid, phthalic acid, isophthalic acid, terephthalic acid, succinic acid, glutaric acid, n-dodecenylsuccinic acid, and anhydrides or lower alkyl esters of these acids.

Examples of trivalent or higher polyvalent carboxylic acid components include 1,2,4-benzenetricarboxylic acid, 2,5,7-naphthalenetricarboxylic acid, pyromellitic acid, empol trimer acid and acid anhydrides and lower alkyl esters thereof. Among them, terephthalic acid is preferably used because a high peak molecular weight can be maintained and durability can be easily maintained.

Examples of the alcohol component for obtaining the amorphous polyester include the following alcohols in addition to a propylene oxide adduct of bisphenol A. Examples of dihydric alcohol components include an ethylene oxide adduct of bisphenol A, ethylene glycol, 1,3-propylene glycol, and neopentyl glycol. Examples of trihydric or higher alcohol components include sorbitol, pentaerythritol, and dipentaerythritol. The dihydric alcohol component and the trihydric or higher polyhydric alcohol component can be used singly or in combination of plural kinds. Among them, an alcohol component derived from bisphenol A is preferably used as the alcohol component from the viewpoint of easy control of the presence state of the below-described release agent.

The amorphous polyester can be produced by an esterification reaction or a transesterification reaction using the alcohol component and the carboxylic acid component. At the time of polycondensation, for example, a known esterification catalyst such as dibutyltin oxide may be appropriately used to advance the reaction.

The molar ratio (carboxylic acid component alcohol component) between the alcohol component and the carboxylic acid component, which are the raw material monomers of the amorphous polyester, is preferably at least 0.60 and not more than 1.00.

From the viewpoints of fixability and heat-resistant storability, the glass transition temperature (Tg) of the amorphous polyester is preferably at least 45° C. and not more than 75° C.

The glass transition temperature (Tg) can be measured with a differential scanning calorimeter (DSC).

The peak molecular weight (Mp (P)) of the amorphous polyester is at least 8000 and not more than 13,000, and the softening point is preferably at least 85° C. and not more than 105° C.

Where the peak molecular weight (Mp (P)) is at least 8000, cracking and crushing of the toner particle during long-term use can be easily suppressed. Further, where the peak molecular weight (Mp (P)) is not more than 13,000, melting caused by heat occurs instantaneously and, therefore, the melt spreading temperature can be easily controlled.

Where the softening point of the amorphous polyester is at least 85° C., cracking and crushing of the toner particle can be easily suppressed over service life. Further, where the softening point is not more than 105° C., melting caused by heat occurs instantaneously and, therefore, the melt spreading temperature can be easily controlled.

In order to control the peak molecular weight and softening point of the amorphous polyester within the above ranges, the unit derived from a straight-chain aliphatic dicarboxylic acid having at least 6 and not more than 12 carbon atoms may be included within the above-mentioned range.

When the toner is subjected to time-of-flight secondary ion mass spectrometry (TOF-SIMS), it is preferable that the following formula (1) be satisfied:

$$0.30 \leq S211/S85 \leq 3.00 \quad (1)$$

where S85 is the peak intensity derived from the vinyl resin and S211 is the peak intensity derived from the amorphous polyester.

In the time-of-flight secondary ion mass spectrometry (TOF-SIMS), information on several nanometers from the surface of the toner particle can be obtained. Therefore, the constituent materials of the outermost layer of the toner particle can be identified. As described above, the configuration of the amorphous polyester that contains an alcohol component derived from bisphenol A is preferable for controlling the below-described presence state of the release agent in the toner, and S211 is the peak derived from the bisphenol A. In the vinyl resin, a styrene-butyl acrylate copolymer is a configuration preferable in terms of realizing both developing performance and fixing performance, and S85 is a peak derived from the butyl acrylate. More preferably, S211/S85 is at least 1.00 and not more than 2.50.

Where S211/S85 is at least 0.30, the amorphous polyester is contained in the vicinity of the surface layer of the toner particle. Therefore, the melt spreading temperature can be easily controlled and white spots can be easily suppressed.

When S211/S85 is not more than 3.00, embedding of external additives can be suppressed, and toner deterioration over durable use can be easily suppressed.

Examples of methods for controlling the presence position of the vinyl resin and the amorphous polyester such that formula (1) is satisfied are presented below.

From the viewpoint of the production method, there can be mentioned control by a suspension polymerization method and a method for controlling the conditions of annealing including a temperature holding step after the polymerization and a cooling step. From the viewpoint of the toner materials, a method for controlling the acid value or hydroxyl value of the amorphous polyester can be mentioned.

Further, it is preferable that in a cross section of the toner particle observed with a transmission electron microscope (TEM), the vinyl resin form a matrix, and the amorphous polyester form domains. It is also preferable that a proportion of the domains of the amorphous polyester present in a region within 25% of a distance between an outline of the cross section and a center point of the cross section from the outline be at least 30% by area and not more than 70% by area with reference to a total area of the domains of the amorphous polyester. A more preferred proportion is at least 40% by area and not more than 70% by area.

Where the area proportion of the domains of the amorphous polyester present within 25% of the distance between the outline of the cross section of the toner particle and the center point of the cross section from the outline (referred to hereinbelow as "25% area ratio") is at least 30% by area, the area increasing rate can be suppressed and the density unevenness and also the cracking and crushing of the toner particle can be easily suppressed through a long-term use, thereby reducing the fogging. Where the area proportion is not more than 70% by area, the melt spreading temperature can be easily controlled and white spots can be easily suppressed. Further, the embedding of external additives can be suppressed, the decrease in flowability over service life can be suppressed, and fogging is less likely to occur.

Next, it is preferred that the proportion of the domains of the amorphous polyester present in a region within 50% of the distance between the outline of the cross section and the center point of the cross section from the outline be at least 80% by area and not more than 100% by area with reference to a total area of the domains of the amorphous polyester. It is more preferably that the proportion be at least 90% by area and not more than 100% by area.

Where the area proportion of the domains of the amorphous polyester present within 50% of the distance between the outline of the cross section of the toner particle and the center point of the cross section from the outline (referred to hereinbelow as "50% area ratio") is at least 80% by area, instantaneous melting at the time of fixing is enabled and, therefore, white spots can be easily suppressed. Further, the presence of the domains on at least 80% by area means that the presence amount of the domains in the region from the center point of the toner particle to 50% of the outline of the toner particle cross section is not more than 20% by area. In such a state, the softening point of the toner can be easily controlled to at least 110° C., excessive melting of the toner on the protrusions and insufficient melting thereof in the depressions of the paper can be reduced at the same time, and density unevenness can be reduced.

Next, it is preferred that, when the area of the domains of the amorphous polyester present within 25% of the distance between the outline of the cross section and the center point of the cross section from the outline is defined as A and the area of the domains of the amorphous polyester present within 25% to 50% of the distance between the outline of the cross section and the center point of the cross section from the outline is defined as B, a ratio (A/B) of A to B be at least 1.05. This indicates that the domains are unevenly distributed on the toner particle surface. The uneven distribution of the domains on the toner particle surface enables instantaneous melting at the time of fixing, thereby making it possible to reduce density unevenness.

The ratio (A/B) of A to B is preferably at least 1.05 and more preferably at least 1.20. Meanwhile, although the upper limit is not particularly restricted, it is preferably not more than 3.00.

Next, it is preferable that the number average diameter of the domains of the amorphous polyester be at least 0.3 μm and not more than 3.0 μm. It is more preferable that the number average diameter be at least 0.3 μm and not more than 2.0 μm. Where the number average diameter of the domains is at least 0.3 μm, the melt spreading of the toner particle can be controlled and density unevenness of the fixed image can be easily controlled. Meanwhile, where the number average diameter of the domains is not more than 3.0 μm, the presence state of the domains inside the toner particle can be easily controlled. Further, the spread in size of the domains among the toner particles can be also reduced. Therefore, white spots can be easily controlled.

As a measure for forming the domains of the amorphous polyester in the vicinity of the toner particle surface and controlling the number average diameter of the domains of the amorphous polyester, it is possible to adjust the acid value and the hydroxyl value of the amorphous polyester, impart a lipophilic moiety to the molecular chain end of the amorphous polyester, adjust the softening point of the amorphous polyester and the toner, and adjust the production conditions of the toner particles, for example, a cooling step after completion of the polymerization, a holding time after cooling, etc.

For example, where the suspension polymerization method is used, the control by the acid value and the hydroxyl value of the amorphous polyester can be performed to form the domains of the amorphous polyester in the vicinity of the toner particle surface and to control the number average diameter of the domains. The adjustment can be also performed by imparting the below-described lipophilic moiety to the molecular chain end of the amorphous polyester, controlling the softening point of the amorphous polyester and the toner, and controlling annealing conditions at the time of toner production.

Next, it is preferable that the acid value Av of the amorphous polyester be at least 1.0 mg KOH/g and not more than 10.0 mg KOH/g. It is more preferably that the acid value Av be at least 4.0 mg KOH/g and not more than 8.0 mg KOH/g. These ranges are preferred because the area proportion of the domains of the amorphous polyester present within 25% of the distance between the outline of the cross section of the toner particle and the center point of the cross section from the outline, and the area ratio of the domains can be easily controlled to specific ranges.

Next, it is preferable that the hydroxyl value OHv of the amorphous polyester be not more than 40.0 mg KOH/g. For example, when the toner particles are obtained by the suspension polymerization method, it is preferable that the hydroxyl value OHv of the amorphous polyester be not more than 40.0 mg KOH/g because the amorphous polyester is likely to form a plurality of domains in the vicinity of the toner particle surface.

In order to control the acid value Av of the amorphous polyester to at least 1.0 mg KOH/g and not more than 10.0 mg KOH/g and control the hydroxyl value OHv to not more than 40.0 mg KOH/g, it is preferable that a lipophilic moiety be imparted to the molecular chain end of the amorphous polyester.

The molecular chain end of the amorphous polyester which has a lipophilic moiety easily interacts with the vinyl resin. As a result, the size and presence position of the domains can be easily controlled.

In order to impart a lipophilic moiety to the molecular chain end, it is preferable that a compound having the lipophilic moiety be reacted with the molecular chain end of the amorphous polyester.

Aliphatic monoalcohols having at least 10 and not more than 50 carbon atoms and/or aliphatic monocarboxylic acids having at least 11 and not more than 51 carbon atoms are preferred as compounds having a lipophilic moiety. Examples of such compounds include dodecanoic acid (lauric acid), tetradecanoic acid (myristic acid), hexadecanoic acid (palmitic acid), octadecanoic acid (stearic acid), eicosanoic acid (arachidic acid), docosanoic acid (behenic acid), tetracosanoic acid (lignoceric acid), capric alcohol, lauryl alcohol, myristyl alcohol, cetanol, stearyl alcohol, arachidyl alcohol, behenyl alcohol, and lignoceryl alcohol.

Next, it is preferable that the toner particle used in the present invention include a release agent. It is also preferable that (i) a domain A of the release agent with a maximum diameter of at least 1.0 μm and not more than 3.0 μm and (ii) a domain B of the release agent with a maximum diameter of at least 5 nm and not more than 500 nm be present in a cross section of the toner particle observed with a transmission electron microscope (TEM).

It is further preferable that, when a proportion of an area occupied by the domain A in the toner particle cross section is defined as SA and a proportion of an area occupied by the domain B is defined as SB, the following formulas (2) and (3) be satisfied.

$$3\% \leq SA \leq 30\% \quad (2)$$

$$0.1 \leq SB/SA \leq 0.8 \quad (3)$$

SA is more preferably at least 5% and not more than 20%. Further, SB/SA is more preferably at least 0.2 and not more than 0.5.

The results of the further detailed investigation conducted by the inventors of the present invention have demonstrated that where the presence state of the release agent present in the toner particle satisfies formulas (2) and (3) above, the effect is exhibited by the suppression of white spots.

As indicated hereinabove, the main cause of the white spots is that the adhesion between the toner particles is insufficient, but the white spots are suppressed to a greater extent by increasing the releasability between the fixing member such as the fixing film and the toner particle. Formulas (2) and (3) above mean that a large release agent domain is present in the toner particle and also finely dispersed small release agent domains are present therein. Apparently the oozing of the release agent to the toner particle surface which is advanced by the finely dispersed small domains becomes a factor that further reduce the white spots. In other words, it is thought that the release agent that forms small domains serves to enhance the oozing of the large domain to the surface, so that oozing to the toner particle surface effectively occurs at the time of fixing.

The maximum diameter of the domain A can be controlled by the number of addition parts of the release agent and the holding time after cooling. The maximum diameter of the domain B can be controlled by the cooling rate and holding time after cooling.

Further, SA can be controlled by the number of addition parts of the release agent and the holding time after cooling. SB can be controlled by the cooling rate and holding time after cooling.

Next, it is preferable that the amount of tetrahydrofuran (THF) insolubles in the resin component of the toner used in the present invention be at least 3% by mass and not more than 50% by mass with respect to the resin component. It is more preferable that this amount be at least 10% by mass and not more than 30% by mass. Where the amount of tetrahydrofuran insolubles is at least 3% by mass, cracking and crushing of the toner particle is easily suppressed through a long-term use, the slope of the area increasing rate can be easily controlled, and density unevenness is reduced. Where the amount of tetrahydrofuran insolubles is not more than 50% by mass, the melt spreading temperature can be easily controlled and white spots can be easily suppressed. The THF insolubles of the resin component of the toner can be controlled by the type and amount of a crosslinking agent.

The weight average particle diameter (D4) of the toner of the present invention is preferably at least 5.0 μm and not more than 12.0 μm, and more preferably at least 5.5 μm and not more than 11.0 pun. Where the weight average particle diameter (D4) is within the above ranges, satisfactory flowability can be obtained and uniform triboelectric charging can be easily performed in a regulating unit. Therefore, fogging can be easily reduced.

The average circularity of the toner of the present invention is preferably at least 0.950 and not more than 1.000. When the average circularity of the toner is at least 0.950, the toner has a spherical or nearly spherical shape and excels in flowability, uniform triboelectric charging can be easily obtained, fogging can be easily suppressed, and transferability is also improved. It is particularly preferable that the mode circularity be at least 0.98 in the circularity distribution of the toner because the above action becomes even more remarkable.

The glass transition temperature (Tg) of the toner of the present invention is preferably at least 40.0° C. and not more than 70.0° C. Where the glass transition temperature is at least 40.0° C. and not more than 70.0° C., it is possible to improve the storage stability and durability of the toner while maintaining satisfactory fixing performance.

Further, the glass transition temperature (Tg) can be measured with a differential scanning calorimeter (DSC).

The toner particles of the present invention may optionally contain a charge control agent for improving charging characteristics. Various charge control agents can be used, but a charge control agent that has a high charging speed and can stably maintain a constant charge quantity is particularly preferable. Further, when the toner base particle is produced using a polymerization method such as described below, a charge control agent having a low polymerization inhibition property and including substantially no substance solubilizable in an aqueous dispersion medium is particularly preferable. Examples of charge control agents include:

metal compounds of aromatic carboxylic acids such as salicylic acid, alkylsalicylic acids, dialkylsalicylic acids, naphthoic acid, and dicarboxylic acids;

metal salts or metal complexes of azo dyes or azo pigments;

polymer type compounds having a sulfonic acid or a carboxylic acid group in a side chain;

boron compounds;

urea compounds;

silicon compounds; and calixarenes.

When added to the inside of the toner particle, the amount used of these charge control agents is preferably at least 0.1 parts by mass and not more than 10.0 parts by mass and more preferably at least 0.1 parts by mass and not more than 5.0 parts by mass with respect to 100 parts by mass of the binder resin. When added to the outside of the toner particles, the amount used of these charge control agents is preferably at least 0.005 parts by mass and not more than 1.000 parts by mass and more preferably at least 0.010 parts by mass and not more than 0.300 parts by mass with respect to 100 parts by mass of the binder resin.

The toner particle used in the present invention may contain a release agent for improving fixing performance. The amount of the release agent in the toner particle is preferably at least 1.0 part by mass and not more than 30.0 parts by mass and more preferably at least 3.0 parts by mass and not more than 25.0 parts by mass with respect to 100 parts by mass of the binder resin.

Where the amount of the release agent is at least 1.0 part by mass, it becomes easier to control to the above-described presence state of the release agent. Therefore, white spots can be easily suppressed to a greater degree. Where the amount of the release agent is not more than 30.0 parts by mass, toner deterioration during long-term use can be easily suppressed.

Examples of the release agent include:

petroleum waxes such as paraffin wax, microcrystalline wax, and petrolactam, and derivatives thereof;

montan wax and derivatives thereof;

hydrocarbon waxes which are obtained by a Fischer-Tropsch process, and derivatives thereof;

polyolefin wax such as polyethylene and derivatives thereof; and natural waxes such as carnauba wax and candelilla wax, and derivatives thereof. Derivatives include oxides, block copolymers with vinyl monomers, and graft modified products. In addition, higher aliphatic alcohols, fatty acids such as stearic acid and palmitic acid, acid amide waxes, ester waxes, hardened castor oil and derivatives thereof, plant waxes, and animal waxes can also be used as the release agent.

Among these release agents, paraffin wax is preferably used from the viewpoint of facilitating the suppression of cracking and crushing of the toner particle, but by using paraffin wax and, for example, ester wax together, it is possible to achieve easily the above-mentioned dispersion state of the release agent. As a result, white spots and also density unevenness can be easily suppressed.

The melting point of these release agents which is defined by the maximum endothermic peak temperature at the time of temperature rise measured by a differential scanning calorimeter (DSC) is preferably at least 60° C. and not more than 140° C. and more preferably at least 65° C. and not more than 120° C. Where the melting point is at least 60° C., toner deterioration during long-term use can be easily suppressed. Where the melting point is not more than 140° C., the low temperature fixability is unlikely to deteriorate. The melting point of the release agent is the peak top of the endothermic peak measured by DSC. Measurements of the peak top of the endothermic peak are carried out according to ASTM D 3417-99. For these measurements, for example, DSC-7 manufactured by PerkinElmer, Inc., DSC 2920 manufactured by TA Instruments and Q1000 manufactured by TA Instruments can be used. For the temperature correction of the device detection unit, the melting points of indium and zinc are used, and for heat quantity correction, the heat of melting of indium is used. In the measurements, an aluminum pan is used for a measurement sample, and an empty pan is set for reference.

Next, a colorant will be described.

Carbon black, magnetic fine particles, and colorants toned in black using the below-described yellow/magenta/cyan colorants can be used as a black colorant.

Another effective means for reducing the printer in size is a mono-component developing method. Yet another effective means is to eliminate the supply roller for supplying the toner in the cartridge to the toner carrying member.

A magnetic mono-component developing method is preferable as such a mono-component developing method in which a supply roller is omitted, and a magnetic toner using magnetic bodies is preferable as the colorant for toner particles. By using such a magnetic toner, it is possible to obtain high transportation performance and tinting performance.

The magnetic fine particles are preferably those containing magnetic iron oxide such as triiron tetroxide or γ-iron oxide as the main component, and may include elements such as phosphorus, cobalt, nickel, copper, magnesium, manganese, aluminum, and silicon. The BET specific area of these magnetic fine particles determined by a nitrogen adsorption method is preferably 2 $m^2/g$ to 30 $m^2/g$, and more preferably 3 $m^2/g$ to 28 $m^2/g$. Also, the magnetic fine particles having a Mohs hardness of 5 to 7 are preferred. The magnetic fine particles may have a polyhedron, octahedron, hexahedron, spherical, needle-like, or scale-like shape, but those with less anisotropy, such as polyhedron, octahedron, hexahedron, and spherical shape are preferred because image density is increased.

The number average particle diameter of the magnetic fine particles is preferably at least 0.10 μm and not more than 0.40 μm. Where the number average particle diameter is at least 0.10 μm, the magnetic fine particles are less likely to agglomerate, and uniform dispersibility of the magnetic fine particles in the toner particle is improved. It is also preferable that the number average particle diameter be not more than 0.40 μm because the tinting strength of the toner is increased.

The number average particle diameter of the magnetic fine particles can be measured using a scanning transmission electron microscope. Specifically, after sufficiently dispersing the toner particles, which are to be observed, in an epoxy resin, the toner is cured for 2 days in an atmosphere at a temperature of 40° C. to obtain a cured product. The cured product thus obtained is sliced into flaky samples with a microtome, and the diameter of 100 magnetic fine particles in a view field is measured in an image captured at a magnification of 10,000 to 40,000 times with a transmission electron microscope (TEM). Then, the number average particle diameter is calculated on the basis of the equivalent diameter of a circle equal to the projected area of the magnetic fine particle. The particle diameter may be also measured by an image analysis apparatus.

The magnetic fine particles to be used in the toner of the present invention can be produced, for example, by the following method. First, an aqueous solution including ferrous hydroxide is prepared by adding an alkali such as sodium hydroxide in an amount equivalent to the iron component or a larger amount to an aqueous ferrous salt solution. Air is then blown while maintaining the pH of the prepared aqueous solution at at least 7.0, the ferrous hydroxide is oxidized while warming the aqueous solution to at least 70° C., and the seed crystals serving as cores of the magnetic iron oxide powder are generated.

Next, an aqueous solution including about 1 equivalent of ferrous sulfate, on the basis of the amount of alkali which has been heretofore added, is added to a slurry-like liquid including the seed crystals. Then, the reaction of ferrous hydroxide is advanced while maintaining the pH of the liquid at 5 to 10 and blowing air, and magnetic iron oxide powder is grown with the seed crystals as the cores. At this time, it is possible to control the shape and magnetic properties of the magnetic fine particles by selecting appropriate pH, reaction temperature, and stirring conditions. As the oxidation reaction advances, the pH of the liquid shifts to the acidic side, but it is preferred that the pH of the liquid be not less than 5. Magnetic fine particles can be obtained by filtering, washing and drying the obtained magnetic fine particles by a conventional method.

In the present invention, when the toner base particles are produced by a suspension polymerization method, hydrophobic treatment of the surfaces of the magnetic fine particles is greatly preferable in that the magnetic fine particles are easily encapsulated in the toner base particles. When the surface treatment is performed by a dry method, the magnetic fine particles which have been washed, filtered and dried are treated with a coupling agent. When the surface treatment is performed by a wet method, the magnetic fine particles dried after completion of the oxidation reaction are redispersed, or the iron oxide body obtained by washing and filtration is redispersed after completion of the oxidation reaction, without drying, in another aqueous medium, and coupling treatment is performed. Specifically, the coupling treatment is performed by adding a silane coupling agent, while sufficiently stirring the redispersion solution, and raising the temperature after hydrolysis, or adjusting the pH of the dispersion to an alkaline range after hydrolysis. Among these methods, from the viewpoint of performing uniform surface treatment, it is preferable to perform surface treatment by filtering and washing after completion of the oxidation reaction, and then directly reslurrying without drying.

In order to perform the surface treatment of the magnetic fine particles by a wet method, that is, to treat the magnetic fine particles with a coupling agent in an aqueous medium, the magnetic fine particles are initially sufficiently dispersed so as to have a primary particle diameter in an aqueous medium, and stirred with a stirring blade, or the like, so as to prevent sedimentation and agglomeration. An appropriate amount of a coupling agent is then loaded into the dispersion, and the surface treatment is performed while hydrolyzing the coupling agent, but in this case it is more preferable to perform surface treatment while sufficiently dispersing, so as to prevent agglomeration, by using an apparatus such as a pin mill and a line mill and performing stirring.

Here, the aqueous medium is a medium containing water as a main component. Specific examples thereof include water itself, water to which a small amount of a surfactant is added, water to which a pH adjuster is added, and water to which an organic solvent is added. A nonionic surfactant such as polyvinyl alcohol is preferable as the surfactant. The surfactant is preferably added in an amount of 0.1 parts by mass to 5.0 parts by mass with respect to 100 parts by mass of water. An inorganic acid such as hydrochloric acid can be used as the pH adjusting agent and alcohols can be used as the organic solvents.

Examples of the coupling agent that can be used for the surface treatment of the magnetic fine particles in the present invention include silane compounds, silane coupling agents, and titanium coupling agents. It is more preferable that a silane compound or a silane coupling agent represented by the following general formula (1) be used.

$$R_mSiY_n \quad (1)$$

[In the formula, R represents an alkoxy group, m represents an integer of 1 to 3, Y represents a functional group such as an alkyl group, a phenyl group, a vinyl group, an epoxy group, and a (meth)acryl group, and n represents an integer of 1 to 3. However, m+n=4.]

Examples of the silane compounds and silane coupling agent represented by the general formula (1) include vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane, and n-octadecyltrimethoxysilane.

Among them, from the viewpoint of imparting high hydrophobicity to magnetic fine particles, it is preferable to use an alkyltrialkoxysilane represented by the following general formula (2).

$$C_pH_{2p+1}—Si—(OC_qH_{2q+1})_3 \quad (2)$$

[In the formula, p represents an integer of 2 to 20 (more preferably 3 to 15), and q represents an integer of 1 to 3 (more preferably 1 or 2).]

Where p in the formula above is at least 2, sufficient hydrophobicity can be easily imparted to the magnetic fine particles. Where p is not more than 20, hydrophobicity is sufficient, and coalescence of magnetic fine particles can also be suppressed. Further, where q is not more than 3, the reactivity of the silane coupling agent is satisfactory and the hydrophobization is sufficient.

When the silane coupling agent is used, the treatment can be performed with a single agent or with a plurality of kinds thereof in combination. When a plurality of kinds of the silane coupling agents is used in combination, the treatment may be conducted with each coupling agent separately or with all agents at the same time.

In the present invention, other colorants may be used in addition to the magnetic fine particles. Examples of the colorants that can be used in combination, include magnetic or nonmagnetic inorganic compounds in addition to the above-mentioned known dyes and pigments. Specific examples include ferromagnetic metal particles of cobalt, nickel or the like, and alloys obtained by adding chromium, manganese, copper, zinc, aluminum, a rare earth element or the like thereto, and particles of hematite or the like, titanium black, nigrosine dye/pigment, carbon black, and phthalocyanine. These are also preferably used after surface treatment.

The amount to be contained in the toner particles is preferably 20 parts by mass to 200 parts by mass, and more preferably 40 parts by mass to 150 parts by mass with respect to 100 parts by mass of the polymerizable monomer which forms the binder resin or the binder resin.

Examples of yellow colorants include compounds represented by condensed azo compounds, isoindolinone compounds, anthraquinone compounds, azo metal complexes, methine compounds, and allyl amide compounds. Specific examples of the colorants include C.I. Pigment Yellow 12, 13, 14, 15, 17, 62, 73, 74, 83, 93, 94, 95, 97, 109, 110, 111, 120, 128, 129, 138, 147, 150, 151, 154, 155, 168, 180, 185, and 214.

Examples of magenta colorants include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples include C.I. Pigment Red 2, 3, 5, 6, 7, 23, 48:2, 48:3, 48:4, 57:1, 81:1, 122, 146, 166, 169, 177, 184, 185, 202, 206, 220, 221, 238, 254, 269, and C.I. Pigment Violet 19.

Examples of cyan colorants include copper phthalocyanine compounds and derivatives thereof, anthraquinone compounds, and basic dye lake compounds. Specific examples include C.I. Pigment Blue 1, 7, 15, 15:1, 15:2, 15:3, 15:4, 60, 62 and 66.

These colorants can be used singly or in mixtures or in a solid solution state. The colorant is selected from the viewpoints of hue angle, chroma, lightness, lightfastness, OHP transparency and dispersibility in a toner particle. The amount added of the colorant is preferably 1 part by mass to 20 parts by mass with respect to 100 parts by mass of the polymerizable monomer which forms the binder resin or the binder resin.

When the toner base particles which are used in the present invention are produced by a pulverization method, for example, toner base particle components such as the binder resin and colorant and, if necessary, a release agent and other additives are sufficiently mixed with a mixer such as a Henschel mixer or a ball mill. The mixture is thereafter melted and kneaded using a thermal kneader such as a heating roll, a kneader, and an extruder to disperse or dissolve the materials, and toner base particles are obtained by solidifying by cooling, pulverizing, then classifying, and optionally performing surface treatment. The order of classification and surface treatment may be reversed. In the classification step, it is preferable to use a multi-division classifier to increase production efficiency.

The control of the dispersion state of the amorphous polyester in the pulverization method can be achieved, for example, by adding the amorphous polyester externally. Accordingly, in the present invention, it is preferable to produce the toner base particles in an aqueous medium by a dispersion polymerization method, an association aggregation method, a dissolution suspension method, and a suspension polymerization method. Among these methods, the suspension polymerization method is more preferable. As a result of using these production methods, it becomes easier to control the abovementioned presence state of the resin in the toner particle.

With the suspension polymerization method, a polymerizable monomer composition is obtained by dissolving or dispersing a polymerizable monomer that will generate the binder resin, an amorphous polyester, and a colorant (and, if necessary, a release agent, a polymerization initiator, a crosslinking agent, a charge control agent, and other additives). Then, a polymerizable monomer composition is added to a continuous phase (for example, an aqueous medium (optionally including a dispersion stabilizer)). Particles of the polymerizable monomer composition are then formed in the continuous phase (in the aqueous medium), and the polymerizable monomer contained in the particles is polymerized. The toner base particles are thus obtained. In the toner base particles obtained by the suspension polymerization method (also referred to hereinbelow as "polymerized toner base particles"), individual toner base particles have a substantially spherical shape and, therefore, the flowability thereof in the regulating unit can be easily increased and triboelectric charging thereof is likely to be uniform. As a result, fogging can be easily suppressed and image quality can be easily increased.

Examples of the polymerizable monomers which are used in the production of the polymerized toner base particles are presented below.

Styrene monomers such as styrene, o-methylstyrene, m-methylstyrene, p-methylstyrene, p-methoxystyrene, and p-ethylstyrene;

acrylic acid esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate, and phenyl acrylate; and methacrylic acid esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate. Other examples include acrylonitriles, methacrylonitriles, and acrylamides. These monomers can be used singly or in combination of plural kinds.

Among the above-described polymerizable monomers, it is preferable to use styrene or styrene derivatives singly or in combination of plural kinds from the viewpoint of development characteristics and durability of the toner.

A polar resin is preferably included in the polymerizable monomer composition. In the suspension polymerization method, as a result of including a polar resin for producing toner base particles in an aqueous medium, it is possible to obtain toner base particles including the polar resin in the surface, the charging performance is likely to improve, and fogging after solid black printing can be easily suppressed.

Examples of polar resins include:

homopolymers of styrene such as polystyrene and polyvinyltoluene, and substitution products thereof;

styrene copolymers such as styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, styrene-dimethylaminoethyl methacrylate copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleic acid ester copolymers; and polymethyl methacrylate, polybutyl methacrylate, polyvinyl acetate, polyethylene, polypropylene, polyvinyl butyral, silicone resins, polyamide resins, epoxy resins, polyacrylic acid resins, terpene resins, and phenolic resins. These can be used singly or in combination of plural kinds. Further, functional groups such as an amino group, a carboxy group, a hydroxyl group, a sulfonic acid group, a glycidyl group, and a nitrile group may be introduced into these polymers.

The polymerization initiator to be used in the manufacture of the toner base particle, which is used in the present invention, by a polymerization method is preferably one having a half-life of at least 0.5 h and not more than 30.0 h during the polymerization reaction. Further, where the polymerization reaction is carried out using an addition amount of at least 0.5 parts by mass and not more than 20.0 parts by mass with respect to 100 parts by mass of the polymerizable monomer, the desired strength and suitable melting characteristics can be imparted to the toner base particle. Specific examples of the polymerization initiator include azo type or diazo type polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile, and peroxide type polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butylperoxy 2-ethylhexanoate, and t-butyl peroxypivalate.

When the base toner particle to be used in the present invention is manufactured by the polymerization method, a crosslinking agent may be added, and the preferred addition amount thereof is at least 0.01 parts by mass and not more than 5.00 parts by mass with respect to 100 parts by mass of the polymerizable monomer.

Mainly compounds having at least two polymerizable double bonds are used as the crosslinking agent, examples thereof including aromatic divinyl compounds such as divinylbenzene and divinylnaphthalene;

carboxylic acid esters having two double bonds, such as ethylene glycol diacrylate, ethylene glycol dimethacrylate, and 1,3-butanediol dimethacrylate;

divinyl compounds such as divinylaniline, divinyl ether, divinylsulfide, and divinylsulfone; and compounds having at least three vinyl groups. These compounds may be used singly or in combination of two or more thereof.

When the toner base particles are produced by a polymerization method, it is preferable that a polymerizable monomer composition be obtained by adding the above-described toner composition and the like and uniformly dissolving or dispersing with a disperser. Examples of the dispersers include a homogenizer, a ball mill, and an ultrasonic disperser. The obtained polymerizable monomer composition is suspended in an aqueous medium including a dispersion stabilizer. In this case, the particle diameter of the obtained toner base particles becomes sharp when the desired size of the toner base particles is rapidly obtained by using a high-speed disperser such as a high-speed stirrer or an ultrasonic disperser. The polymerization initiator may be added when other additives are added to the polymerizable monomer, or may be mixed just before suspending in the aqueous medium. Further, the polymerization initiator can also be added immediately after granulation and before the polymerization reaction is started. After granulation, stirring may be performed with a usual stirrer to a degree such that the particle state is maintained and particle floating/sedimentation are prevented.

When the toner base particle to be used in the present invention is produced, various surfactants, organic dispersing agents, or inorganic dispersing agents, can be used as a dispersion stabilizer. Among them, inorganic dispersing agents are preferably used because hazardous ultrafine particles are unlikely to be generated and dispersion stability is obtained due to steric hindrance thereof. Such inorganic dispersing agents are exemplified by polyvalent metal salts of phosphoric acid such as tricalcium phosphate, magnesium phosphate, aluminum phosphate, zinc phosphate, and hydroxyapatites; carbonates such as calcium carbonate and magnesium carbonate; inorganic salts such as calcium metasilicate, calcium sulfate, and barium sulfate; and inorganic compounds such as calcium hydroxide, magnesium hydroxide, and aluminum hydroxide.

Such inorganic dispersing agents are desirably used in at least 0.2 parts by mass and not more than 20.0 parts by mass with respect to 100 parts by mass of the polymerizable monomer. Further, the dispersion stabilizers may be used singly or in combination of plural kinds. In addition, a surfactant may be used in combination therewith.

In the step of polymerizing the polymerizable monomer, the polymerization temperature is usually set to at least 40° C., and preferably to at least 50° C. and not more than 90° C. When the polymerization is performed in this temperature range, the release agent which is to be sealed inside is precipitated by phase separation to achieve more complete encapsulation.

It is preferable to perform the following steps in the suspension polymerization method in order to obtain toner particles having domains of the amorphous polyester and the above-described domains of the release agent in a preferable state. After the polymerization of the polymerizable monomer has been completed and colored particles have been obtained, the temperature is raised to the vicinity of the softening point of the amorphous polyester (for example, the softening point of the amorphous polyester +10° C.), specifically, to about 100° C., in the state where the colored particles are dispersed in the aqueous medium, followed by holding preferably for at least 30 min. The upper limit is not particularly limited, but from the viewpoint of production takt time, holding is preferably performed for not more than 24 h.

Further, it is preferable to perform the following operations in the subsequent cooling step. Specifically, it is preferable to cool the aqueous medium to not more than the glass transition temperature (Tg) of the toner base particles at a cooling rate of at least 5.0° C./min, more preferably at a cooling rate of at least 20° C./min, and more preferably at a cooling rate of at least 100° C./min. The upper limit of the cooling rate is not more than about 500° C./min from the viewpoint of production takt time.

After cooling at the cooling rate, holding is preferably performed at the attained temperature for at least 30 min. The holding time is more preferably at least 60 min, and still more preferably at least 120 min. The upper limit of the holding time is not particularly limited, but from the viewpoint of production takt time, the holding time is preferably not more than about 24 h.

The obtained polymer particles are filtered, washed, and dried to obtain toner base particles. The peak molecular weight (Mp (T)) of the toner base particles thus obtained is preferably at least 15,000 and not more than 30,000. Where the peak molecular weight (Mp (T)) of the toner base particles is at least 15,000, cracking and crushing of the toner base particles can be easily suppressed over service life. Further, it is preferable that the peak molecular weight (Mp (T)) of the toner base particles be not more than 30,000, because the melt spreading temperature can be easily controlled.

The toner particles can be obtained by mixing, if necessary, inorganic fine particles such as described hereinbelow with the toner base particles and causing the inorganic fine particles to adhere to the surface of the toner base particles. It is also possible to introduce a classification step into the production process (before mixing the inorganic fine particles) and cut coarse powder or fine powder contained in the toner base particles.

Further, in the toner of the present invention, it is preferable that inorganic fine particles having a number average primary particle diameter of at least 4 nm and not more than 80 nm, more preferably at least 6 nm and not more than 40 nm be added (externally added) as a fluidizing agent to the toner base particles. It is more preferable that inorganic fine particles having a number average primary particle diameter of at least 80 nm and not more than 200 nm be used in combination. By doing so, the flowability of the toner can be ensured over service life, uniform and stable triboelectric charging performance is obtained, and fogging can be easily improved. The inorganic fine particles are added for improving the flowability of the toner and charging uniformity of the toner particles, but it is also preferable to impart a function of adjusting the charge quantity of the toner and improving the environmental stability by processing the inorganic fine particles, for example, by hydrophobic treatment.

A method for measuring the number average primary particle diameter of the inorganic fine particles is performed using a micrograph of the toner particles captured under a magnification with a scanning electron microscope.

As the inorganic fine particles used in the present invention, fine particles of silica, titanium oxide, and alumina can be used. As the silica fine particles, for example, both the so-called dry silica produced by vapor phase oxidation of silicon halides or dry silica called fumed silica and the so-called wet silica produced from water glass or the like can be used.

However, dry silica with few silanol groups present on the surface or inside the silica and also few production residues such as $Na_2O$ and $SO_3^{2-}$ is more preferable. Further, the dry silica is also inclusive of composite fine particles of silica and other metal oxides that can be obtained by using other metal halides such as aluminum chloride and titanium chloride together with a silicon halide in the production process.

The amount added of the inorganic fine particles is preferably at least 0.1 parts by mass and not more than 3.0 parts by mass with respect to 100 parts by mass of the toner base particles. The amount of inorganic fine particles can be quantitatively determined using a calibration curve prepared from a standard sample by fluorescent X-ray analysis.

In the present invention, the inorganic fine particles are preferably subjected to hydrophobic treatment because environmental stability of the toner can be improved. Examples of treatment agents suitable for hydrophobic treatment of the inorganic fine particles include silicone varnish, various modified silicone varnishes, silicone oil, various modified silicone oils, silane compounds, and silane coupling agents. Other organosilicon compounds and organotitanium compounds can be also used as the treatment agent. These agents can be used singly or in combination of plural kinds.

Among the above-mentioned treatment agents, those treating the inorganic fine particles with silicone oil are preferable, and those treating the inorganic fine particles with silicone oil at the same time or after the hydrophobic treatment of the inorganic fine particles with a silane compound are more preferable. As a method for treating such inorganic fine particles, for example, it is possible to perform a silylation reaction with a silane compound as a first-stage reaction, eliminate silanol groups by chemical bonding, and then form a hydrophobic thin film on the surface with silicone oil as a second-stage reaction.

The silicone oil preferably has a viscosity (at 25° C.) of at least 10 $mm^2/s$ and not more than 200,000 $mm^2/s$, and more preferably at least 3,000 $mm^2/s$ and not more than 80,000 $mm^2/s$.

As the silicone oil to be used, dimethyl silicone oil, methylphenyl silicone oil, α-methylstyrene-modified silicone oil, chlorophenyl silicone oil, and fluorine-modified silicone oil, for example, are particularly preferable.

Examples of methods for treating inorganic fine particles with silicone oil include a method of directly mixing inorganic fine particles treated with a silane compound with a silicone oil by using a mixer such as a Henschel mixer, and a method of spraying silicone oil onto the inorganic fine particles. In an alternative method, silicone oil is dissolved or dispersed in an appropriate solvent, inorganic fine particles are added and mixed therewith, and the solvent is removed. A method of spraying is preferable in that generation of aggregates of inorganic fine particles is relatively small.

The treatment amount of the silicone oil is preferably 1 part by mass to 40 parts by mass, and more preferably 3 parts by mass to 35 parts by mass with respect to 100 parts by mass of the inorganic fine particles. Within this range, satisfactory hydrophobicity can be easily obtained.

In order to impart satisfactory flowability to the toner, the inorganic fine particles used in the present invention preferably have a specific surface area measured by the BET method based on nitrogen adsorption within the range of 20 $m^2/g$ to 350 $m^2/g$, and more preferably 25 $m^2/g$ to 300 $m^2/g$. The specific surface area is calculated using a BET multipoint method by causing adsorption of nitrogen gas on the sample surface with a specific surface area measuring apparatus Autosorb 1 (manufactured by Yuasa Ionics Co., Ltd.) according to the BET method.

The toner base particles of the present invention may further include small amounts of other additives, for example, a lubricant powder such as fluororesin particles, zinc stearate particles, and polyvinylidene fluoride particles;

a polishing agent such as cerium oxide particles, silicon carbide particles, and strontium titanate particles;

flowability imparting agents such as titanium oxide particles and aluminum oxide particles;

an anti-caking agent; and organic fine particles and inorganic fine particles of opposite polarity as agents improving developing performance. These additives can be also used after subjecting the surface thereof to hydrophobic treatment.

The present invention relates to a developing device having a toner for developing an electrostatic latent image formed on an image bearing member, and a toner carrying member that carries the toner and transports the toner to the electrostatic latent image bearing member. The developing apparatus preferably used in the present invention will be described in detail with reference to the drawings.

FIG. 1 is a schematic cross-sectional view showing an example of a developing device. Further, FIG. 2 is a schematic cross-sectional view showing an example of an image forming apparatus in which the developing device is incorporated.

Figure 2:
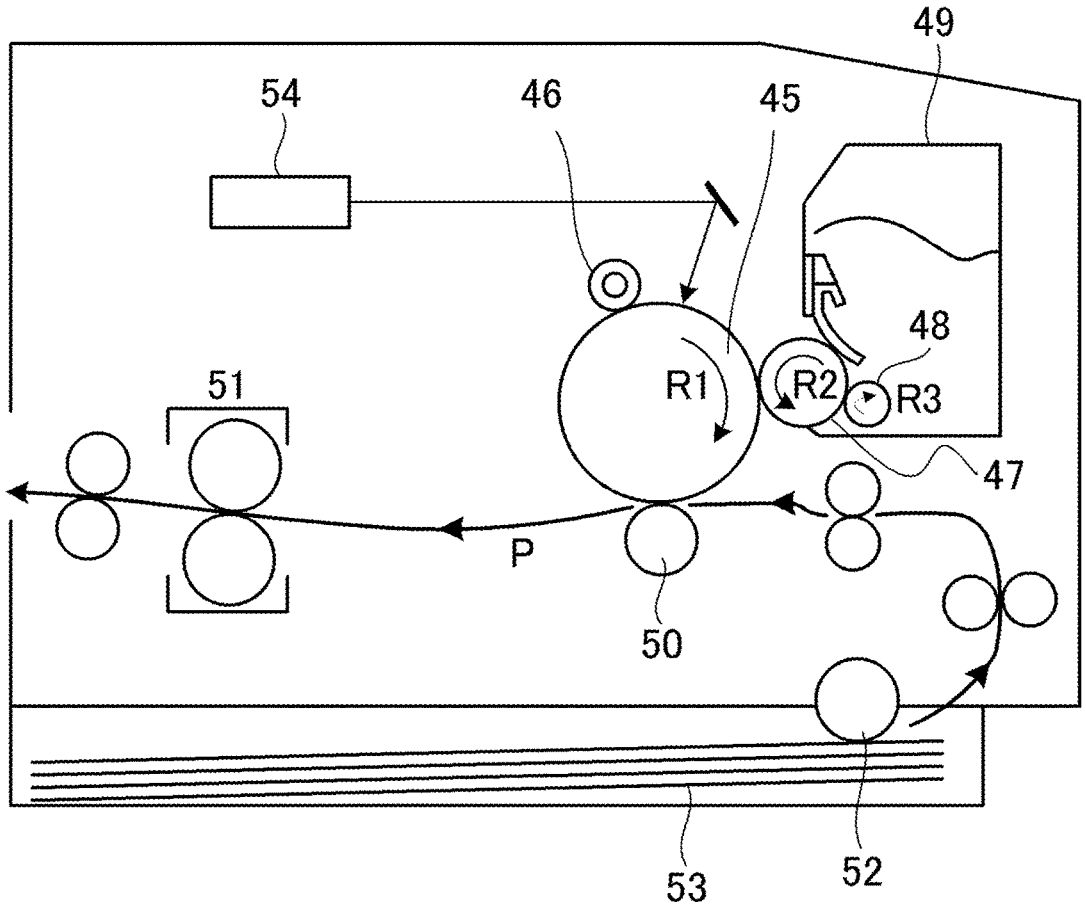
FIG. 2 shows an example of an image forming apparatus.

In FIG. 1 or FIG. 2, an electrostatic latent image bearing member 45, which is an image bearing member on which an electrostatic latent image is formed, is rotated in the direction of an arrow R1. As a result of the toner carrying member 47 rotating in the direction of an arrow R2, a toner 57 is transported to the developing region where the toner carrying member 47 and the electrostatic latent image bearing member 45 are opposed. A toner supply member 48 is in contact with the toner carrying member and rotates in the direction of an arrow R3, thereby supplying the toner 57 to the surface of the toner carrying member.

A charging member (charging roller) 46, a transfer member (transfer roller) 50, a fixing device 51, a pickup roller 52 and the like are provided around the electrostatic latent image bearing member 45. The electrostatic latent image bearing member 45 is charged by the charging roller 46. Then, by irradiating the electrostatic latent image bearing member 45 with a laser beam with a laser generator 54, exposure is performed, and an electrostatic latent image corresponding to a target image is formed. The electrostatic latent image on the electrostatic latent image bearing member 45 is developed with the toner in a developing unit 49 to obtain a toner image. The toner image is transferred onto a transfer material (paper) 53 by a transfer member (transfer roller) 50 that is in contact with the electrostatic latent image bearing member 45, with a transfer material being interposed therebetween. The transfer material (paper) 53 on which the toner image is placed is conveyed to the fixing device 51 and the toner image is fixed on the transfer material (paper) 53. When a cleanerless system is used, the toner remaining on the electrostatic latent image bearing member is collected without providing a cleaning blade for removing the untransferred toner on the electrostatic latent image bearing member downstream of the transfer member and upstream of the charging roller.

In the charging step in the developing device, it is preferable to use a contact charging device in which the electrostatic latent image bearing member and the charging roller make contact with each other and form a contact region, and a predetermined charging bias is applied to the charging roller so that the surface of the electrostatic latent image bearing member is charged to predetermined polarity and potential. By performing contact charging in such a manner, it is possible to perform stable and uniform charging, and it is also possible to reduce generation of ozone. It is more preferable to use a charging roller that rotates in the same direction as the electrostatic latent image bearing member in order to maintain uniform contact with the electrostatic latent image bearing member and perform uniform charging.

Next, it is preferable that the thickness of the toner layer on the toner carrying member be regulated by a toner regulating member 55 that comes into contact with the toner carrying member, with the toner being interposed therebetween (56 is a metal plate). As a result, it is possible to obtain high image quality without regulation defects. As the toner regulating member 55 which is in contact with the toner carrying member, a regulating blade is generally used, and it can be advantageously used also in the present invention.

The developing step is preferably a step of applying a developing bias to the toner carrying member to transfer the toner to the electrostatic latent image on the electrostatic latent image bearing member and form a toner image. The applied developing bias may be a DC voltage or a voltage obtained by superposing an AC field on a DC voltage.

A sine wave, a rectangular wave, a triangular wave or the like can be appropriately used as the waveform of the AC field. It may be a pulse wave formed by periodically turning ON/OFF a DC power supply. A bias with a periodically changing voltage value can thus be used as the waveform of the AC field.

Figure 3:
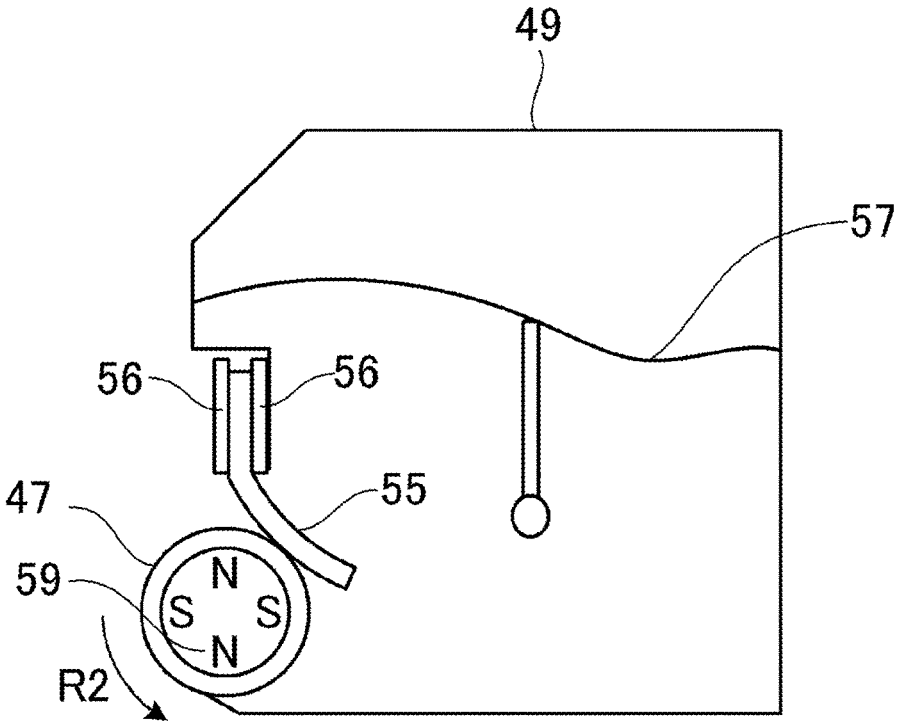
FIG. 3 is an example of a developing device in which a magnet is disposed inside a toner carrying member.

When a method of transporting a toner by magnetism without using a toner supply member is used in the present invention, it is preferable to dispose a magnet inside the toner carrying member (reference numeral 59 in FIG. 3). In this case, it is preferable that the toner carrying member have a fixed magnet having multiple poles inside, and the number of the magnetic poles is preferably 3 to 10.

Next, methods for measuring physical properties according to the present invention will be described.

<Method for Measuring Melt Spreading Temperature and Area Increasing Rate of Toner>

A total of 3 mg of toner is placed in the center of cover glass (Matsunami Glass Ind., Ltd., angular cover glass 18×18 mm, No. 1, Model No. C218181, glass with a thickness from 0.14 mm to 0.16 mm is selected) and fixed on a horizontal table. After the cover glass has been fixed, an air pressure of 0.05 MPa is applied for 10 sec from 6 cm above the cover glass at an angle of 45 degrees to disperse the toner particles on the cover glass.

Next, this cover glass is observed under an optical microscope, and it is confirmed that isolated toner particles are present in the center of a 10 mm square. In the unlikely event that isolated toner particles are not observed, air is appropriately applied under the same conditions as above to disperse the particles. After confirmation, cover (Matsunami Glass Ind., Ltd., angular cover glass 18×18 mm, No. 1, Model No. C218181) is further placed on the dispersed toner particles to sandwich the toner particles.

The prepared sample is then placed on a heating stage (model: TH-600PM) manufactured by Linkam Scientific Instruments, and in that state, an optical microscope is focused on isolated toner particles. The microscope is focused on the toner particles which have adhered to the cover glass on the heating stage side. After adjustment, the temperature of the heating stage is raised to 40° C. and the particles are photographed. The photograph is taken using Image Pro PLUS (manufactured by Nippon Roper K.K.). Binarization processing is then performed on the photographed image by also using the Image Pro PLUS. The area of the toner particle is obtained by the binarization processing and is defined as S(40).

Next, the temperature of the heating stage is raised from 40° C. to 160° C. at a heating rate of 90° C./min (1.5° C./sec). At this time, photographs are taken at intervals of 10° C., and the area of each toner particle is obtained by the binarization processing.

Through this binarization processing, the temperature at the time when the area becomes 1.40 times larger than S(40)

is obtained by extrapolation. Further, the slope of the area increasing rate is calculated from the slope when the area increasing rate is from 1.40 to 2.00. This series of measurements is performed using ten isolated toner particles, and the average value of each is calculated.

<Method for Measuring Softening Point of Toner and Amorphous Polyester>

Measurement of the softening point of the toner and amorphous polyester is performed using a constant load extrusion-type capillary rheometer "Device for evaluating flow characteristics, Flow Tester CFT-500D" (manufactured by Shimadzu Corporation) according to the manual provided with the device. In this device, the temperature of a measurement sample filled in a cylinder is raised and the sample is melted while applying a constant load with a piston from above the measurement sample, the melted measurement sample is extruded from a die at the bottom of the cylinder, and the flow curve representing the relationship between the piston descent amount and temperature at this time can be obtained.

In the present invention, the "Melting Temperature in ½ Method" described in the manual provided with the "Device for evaluating flow characteristics, Flow Tester CFT-500D" is taken as the softening point. The melting temperature in the ½ method is calculated in the following manner. First, ½ of the difference between the descent amount Smax of the piston at the time when the outflow has ended and the descent amount Smin of the piston at the time when the outflow has started is calculated (This is taken as X. X=(Smax−Smin)/2). The temperature at the flow curve when the descending amount of the piston in the flow curve is the sum of X and Smin is the melting temperature in the ½ method.

The measurement sample is of a columnar shape having a diameter of about 8 mm and is prepared by compression molding about 1.0 g of the toner or amorphous polyester for about 60 sec at about 10 MPa under an environment of 25° C. by using a tablet compacting compressor (for example, NT-100H, manufactured by NPa System Co., Ltd.).

Measurement conditions of CFT-500D are described below.

Test mode: temperature rising method
Starting temperature: 50° C.
Temperature reached: 200° C.
Measurement interval: 1.0° C.
Temperature rise rate: 4.0° C./min
Piston cross section area: 1.000 $cm^2$
Test load (piston load): 10.0 kgf (0.9807 MPa)
Preheating time: 300 sec
Die hole diameter: 1.0 mm
Die length: 1.0 mm <Method for Measuring Weight Average Particle Diameter (D4)>

The weight average particle diameter (D4) of the toner was calculated by using a precision particle size distribution measuring apparatus "Coulter Counter Multisizer 3" (registered trademark, manufactured by Beckman Coulter, Inc.) based on a pore electrical resistance method and equipped with a 100 μm aperture tube and dedicated software "Beckman Coulter Multisizer 3 Version 3.51" (manufactured by Beckman Coulter, Inc.) for setting measurement conditions and analyzing measurement data, performing the measurements with the number of effective measurement channels of 25,000, and analyzing the measurement data.

An electrolytic aqueous solution that can be used for the measurements is, for example, "Isoton II" (manufactured by Beckman Coulter, Inc.) prepared by dissolving special grade sodium chloride in ion-exchanged water to a concentration of about 1% by mass.

The dedicated software is set as follows before the measurements to perform the analysis.

On the "CHANGE STANDARD MEASUREMENT METHOD (SOM) SCREEN" of the dedicated software, the total count number of the control mode is set to 50,000 particles, one measurement cycle is performed, and a value obtained by using "STANDARD PARTICLE 10.0 μm" (manufactured by Beckman Coulter, Inc.) is set as a Kd value. The threshold and the noise level are automatically set by pressing the "THRESHOLD/NOISE LEVEL MEASUREMENT BUTTON". Further, the current is set to 1600 μA, the gain is set to 2, the electrolytic solution is set to Isoton II, and "FLUSH APERTURE TUBE AFTER MEASUREMENT" is checked.

On the "SCREEN FOR CONVERSION SETTING FROM PULSE TO PARTICLE DIAMETER" of the dedicated software, the bin interval is set to a logarithmic particle diameter, the particle diameter bin is set to 256 particle diameter bins, and the particle diameter range is set to at least 2 μm and not more than 60 μm.

Specific measurement methods are described below.

(1) About 200 mL of the electrolytic aqueous solution is placed in a 250 mL round-bottom glass beaker specifically designed for Multisizer 3, the beaker is set in a sample stand, and stirring with a stirrer rod is performed counterclockwise at 24 rev/sec. Dirt and air bubbles in the aperture tube are removed by the "FLASH OF APERTURE" function of the dedicated software.

(2) About 30 mL of the electrolytic aqueous solution is placed in a glass 100 mL flat-bottom beaker, and a diluted solution, about 0.3 mL, prepared by diluting "Contaminon N" (10% by mass aqueous solution of a neutral detergent of pH 7 for washing precision measuring instruments composed of a nonionic surfactant, an anionic surfactant, and an organic builder; manufactured by Wako Pure Chemical Industries, Ltd.) by a mass factor of 3 with ion-exchanged water is added as a dispersing agent thereto.

(3) A predetermined amount of ion-exchanged water is placed in a water tank of an ultrasonic disperser "Ultrasonic Dispersion System Tetora 150" (manufactured by Nikkaki Bios Co., Ltd.) which has an electrical output of 120 W and incorporates two oscillators with an oscillation frequency of 50 kHz in a state with a phase shift of 180 degrees, and about 2 mL of Contaminon N is added into the water tank.

(4) The beaker of (2) is set in a beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) About 10 mg of the toner is added little by little to the electrolytic aqueous solution and dispersed while irradiating the electrolytic aqueous solution in the beaker of (4) with ultrasonic waves. Then, the ultrasonic dispersion treatment is further continued for 60 seconds. During the ultrasonic dispersion the water temperature in the water tank is adjusted as appropriate to at least 10° C. and not more than 40° C.

(6) The electrolytic aqueous solution of (5) in which the toner has been dispersed is dropwise added using a pipette to the round-bottom beaker of (1) which has been placed in the sample stand, and the measurement concentration is adjusted to about 5%. Then, measurement is performed until the number of particles to be measured reaches 50,000.

(7) The measurement data are analyzed with the dedicated software provided with the apparatus to calculate the weight average particle diameter (D4). The "ARITHMETIC DIAMETER" on the analysis/volume statistical value (arithmetic average) screen when set as graph/% by volume with the dedicated software is the weight average particle diameter (D4).

<Method for Measuring Average Circularity of Toner>

The average circularity of the toner is measured by a flow-type particle image analyzer "FPIA-3000" (manufactured by Sysmex Corporation) under measurement and analysis conditions at the time of calibration operation.

A specific measurement method is described below.

First, about 20 mL of ion-exchanged water from which solid impurities have been removed in advance is placed in a glass container, and a diluted solution, about 0.2 mL, prepared by diluting "Contaminon N" (10% by mass aqueous solution of a neutral detergent of pH 7 for washing precision measuring instruments composed of a nonionic surfactant, an anionic surfactant, and an organic builder; manufactured by Wako Pure Chemical Industries, Ltd.) by a mass factor of about 3 with ion-exchanged water is added as a dispersing agent thereto. About 0.02 g of the measurement sample is further added and dispersion treatment is performed for 2 min by using an ultrasonic disperser to obtain a dispersion for measurement. In this case, cooling is appropriately performed so that the temperature of the dispersion is at least 10° C. and not more than 40° C. As the ultrasonic disperser, a desktop ultrasonic cleaner disperser (for example, "VS-150" (manufactured by Velvo-Clear Co.)) having an oscillation frequency of 50 kHz and an electrical output of 150 W is used, a predetermined amount of ion-exchanged water is placed in a water tank, and about 2 mL of Contaminon N is added to the water tank. For the measurement, a flow-type particle image analyzer equipped with "LUCPLFLN" (magnification: 20 times, numerical aperture: 0.40) as an objective lens is used and a particle sheath "PSE-900A" (manufactured by Sysmex Corporation) is used for a sheath liquid. The dispersion prepared according to the above procedure is introduced into the flow-type particle image analyzer, and 2000 toner particles are measured in a total count mode in a HPF measurement mode. Further, the binarization threshold at the time of particle analysis is set to 85%, and the analysis particle diameter is limited to an equivalent circle diameter of at least 1.977 μm and less than 39.54 μm, and the average circularity of the toner is obtained.

For the measurement, automatic focus adjustment is performed using standard latex particles (for example, "RESEARCH AND TEST PARTICLES Latex Microsphere Suspensions 5100A" manufactured by Duke Scientific Corporation, diluted with ion-exchanged water) before the start of the measurement. After that, it is preferable to perform focus adjustment every two hours from the start of the measurement.

In the examples in the present application, a flow-type particle image analyzer which was calibrated by Sysmex Corporation and for which a calibration certificate was issued by Sysmex Corporation was used. Measurements were carried out under measurement and analysis conditions at the time the calibration certification was received, except that the analysis particle diameter was limited to an equivalent circle diameter of at least 1.977 μm and less than 39.54 μm.

<Method for Measuring Peak Molecular Weight Mp (T) of Toner and Peak Molecular Weight Mp (P) of Amorphous Polyester>

The molecular weight distribution of THF insolubles of the toner and the amorphous polyester is measured in the following manner by using gel permeation chromatography (GPC).

First, the toner is dissolved in tetrahydrofuran (THF) over 24 h at room temperature. Then, the obtained solution is filtered through a solvent-resistant membrane filter "Sample Pretreatment Cartridge" (manufactured by Tosoh Corporation) having a pore diameter of 0.2 m to obtain a sample solution. The sample solution is adjusted so that the concentration of the component soluble in THF is about 0.8% by mass. Measurements are performed under the following conditions by using this sample solution.

Apparatus: HLC-8120 GPC (Detector: RI) (manufactured by Tosoh Corporation)

Column: 7 sets of Shodex KF-801, 802, 803, 804, 805, 806, 807 (Showa Denko K.K.)

Eluent: tetrahydrofuran (THF)

Flow rate: 1.0 mL/min

Oven temperature: 40.0° C.

Sample injection amount: 0.10 mL

When the molecular weight of the sample is calculated, a molecular weight calibration curve is used which is prepared using a standard polystyrene resin (for example, trade name "TSK Standard Polystyrene F-850, F-450, F-288, F-128, F-80, F-40, F-20, F-10, F-4, F-2, F-1, A-5000, A-2500, A-1000, A-500", manufactured by Tosoh Corporation).

<Method for Measuring 25% Area Ratio, 50% Area Ratio, and Area Ratio of Domains>

The toner is sufficiently dispersed in a visible-light-curable resin (Aronix, LCR series D800) and then cured by irradiation with short wavelength light. The obtained cured product is cut with an ultramicrotome equipped with a diamond knife to prepare a 250 nm flaky sample. The cross section of the toner particle is observed by observing the cut sample at a magnification of 40,000 to 50,000 times by using a transmission electron microscope (electron microscope JEM-2800 manufactured by JEOL Ltd.) (TEM-EDX), and element mapping is performed using EDX.

The cross section of the toner particle to be observed is selected in the following manner. First, the cross-sectional area of the toner particle is obtained from the cross-sectional image of the toner particle, and the diameter of a circle having the same area as the cross-sectional area (circle equivalent diameter) is obtained. Observations are performed only with respect to the cross-sectional image of the toner particle where the absolute value of the difference between the circle equivalent diameter and the weight average particle diameter (D4) of the toner is within 1.0 μm.

A preservation rate of 9000 to 13,000 and an accumulation number of 120 are taken as the mapping conditions. The spectral intensity derived from the C element and the spectral intensity derived from the O element in each domain derived from the resin which is confirmed from the observation image are measured, and the domain in which the spectral intensity of the C element related to the spectral intensity of the O element is at least 0.05 is the domain of the amorphous polyester. The area ratio (area %) of the amorphous polyester domains present within 25% of the distance between an outline of the cross section and a center point of the cross section from the outline to the total area of the domains of the amorphous polyester present in the toner particle cross section is calculated by binarization processing after specifying the domains of the amorphous polyester. The Image Pro PLUS (manufactured by Nippon Roper K.K.) is used for the binarization processing.

The calculation method is described below. The outline and center point of the toner particle cross section are found in the TEM image. The outline of the cross section of the toner particle is assumed to be along the surface of the toner particle observed in the TEM image. The center point of the toner particle cross section is the center of gravity of the cross section of the toner particle. A line is drawn from the obtained center point to a point on the outline of the toner particle cross section. A position at 25% of the distance between the outline and the center point of the cross section from the outline is specified on the line.

Then, this operation is performed for one round with respect to the outline of the toner particle cross section, and a boundary line at 25% of the distance between the outline of the toner particle cross section and the center point of the cross section from the outline is clearly indicated.

The area of the domains of the amorphous polyester present in the region surrounded by the outline of the cross section of the toner particle and the 25% boundary line is measured on the basis of the TEM image in which the 25% boundary line is clearly indicated. Then, the total area of the amorphous polyester domains present in the toner particle cross section is measured, and the area % based on the total area is calculated.

(50% Area Ratio)

A boundary line at 50% of the distance between the outline of the toner particle cross section and the center point of the cross section from the outline is clearly indicated in the same manner as in the above-described measurement of the 25% area ratio. The area of the domains of the amorphous polyester present in the region surrounded by the outline of the cross section of the toner particle and the 50% boundary line is measured, and the area % based on the total domain area is calculated.

(Area Ratio of Domains)

The ratio of the area of the amorphous polyester domains present within 25% of the distance between the outline of the cross section of the toner particle and the center point of the cross section from the outline and the area of the amorphous polyester domains present in 25% to 50% of the distance between the outline of the cross section of the toner particle and the center point of the cross section from the outline (area ratio of domains) is obtained by the following formula by using the calculated values obtained from the above.

Area ratio of domains =(25% area ratio (area %))/[(50% area ratio (area %))−(25% area ratio (area %))]

<Method for Measuring Number Average Diameter (D1) of Domains of Amorphous Polyester>

Element mapping is performed using EDX in the same manner as above to specify the amorphous polyester domain.

The number average diameter of the domains is obtained by obtaining the circle equivalent diameter from the domain area. The number of measurements is 100, and the arithmetic mean value of the circle equivalent diameter of 100 domains is taken as the number average diameter of the domains. Toner particles for calculating the number average diameter of the domains are determined in the following manner.

First, the cross-sectional area of a toner particle is obtained from the cross-sectional image of the toner particle, and the diameter (circle equivalent diameter) of a circle having the same area as the cross-sectional area is obtained. The domain diameter is calculated only for the toner particle cross-sectional image with an absolute value of the difference between the circle equivalent diameter and the weight average particle diameter (D4) of the toner within 1.0 μm. Since the domain diameter sometimes varies depending on the diameter of the toner particles, such an approach makes it possible to calculate the average domain diameter.

<Method for Measuring Acid Value Av of Amorphous Polyester>

The acid value is the number of milligrams of potassium hydroxide necessary to neutralize the acid contained in 1 g of the sample. The acid value of the amorphous polyester is measured according to JIS K 0070-1992, more specifically, according to the following procedure.

(1) Preparation of Reagent

A phenolphthalein solution is obtained by dissolving 1.0 g of phenolphthalein in 90 mL of ethyl alcohol (95% by volume) and adding ion-exchanged water to make 100 mL.

A total of 7 g of special grade potassium hydroxide is dissolved in 5 mL of water, and ethyl alcohol (95% by volume) is added to make 1 L. The solution is poured in an alkali-resistant container and allowed to stand for 3 days so as to prevent contact with carbon dioxide, etc., and then filtered to obtain a potassium hydroxide solution. The obtained potassium hydroxide solution is stored in the alkali-resistant container. A total of 25 mL of 0.1 mol/L hydrochloric acid is taken into an Erlenmeyer flask, a few drops of the phenolphthalein solution are added, titration with the potassium hydroxide solution is performed, and the factor of the potassium hydroxide solution is determined from the amount of the potassium hydroxide solution required for neutralization. The 0.1 mol/L hydrochloric acid is prepared according to JIS K 8001-1998.

(2) Operation (A) Main Test

A total of 2.0 g of the crushed sample of the amorphous polyester is accurately weighed into a 200 mL Erlenmeyer flask, 100 mL of a mixed solution of toluene/ethanol (2:1) is added, and dissolution is performed over 5 h. Then, a few drops of the phenolphthalein solution as an indicator are added and titration is performed with the potassium hydroxide solution. The end point of the titration is when the light crimson color of the indicator lasts about 30 sec.

(B) Blank Test

The titration is performed in the same manner as in the above-described operation, except that no sample is used (that is, only a mixed solution of toluene/ethanol (2:1) is used).

(3) The obtained result is substituted into the following formula to calculate the acid value.

$$A=[(C-B)\times f\times 5.61]/S$$

Here, A: acid value (mg KOH/g), B: amount (mL) added of the potassium hydroxide solution in the blank test, C: amount (mL) added of the potassium hydroxide solution in the main test, f: factor of the potassium hydroxide solution, and S: sample (g).

<Method for Measuring Hydroxyl Value OHv of Amorphous Polyester>

The hydroxyl value is the number of milligrams of potassium hydroxide required to neutralize acetic acid bonded to hydroxyl groups when 1 g of a sample is acetylated. The hydroxyl value of the amorphous polyester in the present invention is measured according to JIS K 0070-1992, more specifically, according to the following procedure.

(1) Preparation of Reagent

A total of 25 g of special grade acetic anhydride is placed in a 100 mL measuring flask, pyridine is added to bring the total volume to 100 mL, and an acetylation reagent is obtained by sufficient shaking. The obtained acetylation reagent is stored in a brown bottle so as to prevent contact with moisture, carbon dioxide, etc.

A phenolphthalein solution is obtained by dissolving 1.0 g of phenolphthalein in 90 mL of ethyl alcohol (95% by volume) and adding ion-exchanged water to make 100 mL.

A total of 35 g of special grade potassium hydroxide is dissolved in 20 mL of water and ethyl alcohol (95 vol %) is added to make 1 L. The solution is poured in an alkali-resistant container and allowed to stand for 3 days so as to prevent contact with carbon dioxide, etc., and then filtered to obtain a potassium hydroxide solution. The obtained potassium hydroxide solution is stored in the alkali-resistant container. A total of 25 mL of 0.5 mol/L hydrochloric acid is taken into an Erlenmeyer flask, a few drops of the phenolphthalein solution are added, titration with the potassium hydroxide solution is performed, and the factor of the potassium hydroxide solution is determined from the amount of the potassium hydroxide solution required for neutralization. The 0.5 mol/L hydrochloric acid is prepared according to JIS K 8001-1998.

(2) Operation (A) Main Test

A total of 1.0 g of the crushed sample of the amorphous polyester is accurately weighed in a 200 mL round-bottom flask, and 5.0 mL of the acetylation reagent is accurately added to the sample by using a hole pipette. In this case, when the sample is difficult to dissolve in the acetylation reagent, a small amount of special grade toluene is added for dissolution.

A small funnel is placed in the mouth of the flask and heating is performed by immersing the bottom of the flask to about 1 cm in a glycerin bath at about 97° C. At this time, in order to prevent the temperature of the neck of the flask from rising due to the heat of the bath, it is preferable to cover the neck of the flask with cardboard having a round hole.

After 1 h, the flask is removed from the glycerin bath and allowed to cool. After cooling, 1 mL of water is added from the funnel, and the funnel is shaken to hydrolyze acetic anhydride. For even more complete hydrolysis, the flask is again heated in the glycerin bath for 10 min. After cooling, the walls of the funnel and flask are washed with 5 mL of ethyl alcohol.

A few drops of the phenolphthalein solution as an indicator are added and titration is performed with the potassium hydroxide solution. The end point of the titration is when the light crimson color of the indicator lasts about 30 sec.

(B) Blank Test

The titration is performed in the same manner as in the above-described Operation, except that no sample of the amorphous polyester is used.

(3) The obtained result is substituted into the following formula to calculate the hydroxyl value.

$$A=[\{(B-C)\times 28.05\times f\}/S]+D$$

Here, A: hydroxyl value (mg KOH/g), B: amount (mL) added of the potassium hydroxide solution in the blank test, C: amount (mL) added of the potassium hydroxide solution in the main test, f: factor of the potassium hydroxide solution, S: sample (g), and D: acid value (mg KOH/g) of the amorphous polyester.

<Method for Measuring Intensity Ratio (S211/S85) of Peak Intensity (S211) Derived from Amorphous Polyester and Peak Intensity (S85) Derived from Vinyl Resin by Time-of-Flight Secondary Ion Mass Spectrometry (TOF-SIMS)>

TRIFT-IV (manufactured by ULVAC-PHI, Inc.) is used to measure the intensity ratio (S211/S85) of the peak intensity (S211) derived from the amorphous polyester and the peak intensity (S85) derived from the vinyl resin by using TOF-SIMS.

The analysis conditions are presented below.

Sample preparation: The toner is caused to adhere to an indium sheet.

Sample pretreatment: None

Primary ion: Au+

Accelerating voltage: 30 kV

Charge neutralization mode: On

Measurement mode: Negative

Raster: 100 μm

Calculation of peak intensity (S85) derived from the vinyl resin: The total count number of mass numbers 84.5 to 85.5 is taken as the peak intensity (S85) according to standard software (Win Cadense) of ULVAC-PHI, Inc.

Calculation of peak intensity (S211) derived from the amorphous polyester: The total count number of mass numbers 210.5 to 211.5 is taken as the peak intensity (S211) according to standard software (Win Cadense) of ULVAC-PHI, Inc.

Calculation of intensity ratio (S211/S85): The intensity ratio (S211/S85) is calculated using S85 and S211 calculated as described above.

<Measurement of Maximum Diameter of Domains of Release Agent>

The maximum diameter of the domains of the release agent is measured in the cross section of a toner particle having a long diameter R (μm) satisfying the relationship of $0.9 \leq R/D4 \leq 1.1$ with the weight average particle diameter (D4) on the basis of the TEM image obtained by observing in the transmission electron microscope (TEM) the toner particle cross section subjected to the ruthenium dyeing treatment. A domain having a maximum diameter of at least 0.7 μm and not more than 6.0 μm is selected and an arithmetic mean value of cross sections of 100 toner particles is taken as the maximum diameter of the domain A. Further, a domain with a maximum diameter of at least 1 nm and less than 700 nm is selected, and an arithmetic average value of cross sections of 100 toner particles is set as the maximum diameter of the domain B.

A method for TEM observations of a ruthenium-stained toner particle cross section is described below.

A toner particle cross section is observed by staining the toner particle cross section with ruthenium. Since the release agent is stained with ruthenium to a degree greater than that of the binding resin, the contrast becomes clear and observation becomes easy. Because the amount of ruthenium atoms varies depending on the strength of staining, a strongly stained portion contains a large number of these atoms, the electron beam does not penetrate therethrough, and the portion becomes black on the observation image. A weakly stained portion easily transmits an electron beam and become white on the observation image.

First, toner particles are scattered as a single layer on a cover glass (Matsunami Glass Ind., Ltd., angular cover glass, Square, No. 1), and an Os film (5 nm) and a naphthalene film (20 nm) are formed as protective films on the toner particles by using an osmium plasma coater (Filgen, Inc., OPC80T). Next, a photocurable resin D800 (JEOL Ltd.) is filled in a PTFE tube (ϕ1.5 mm×ϕ3 mm×3 mm), and the cover glass is quietly placed on the tube with an orientation such that the toner particles come into contact with the photocurable resin D800. In this state, the resin is cured by light irradiation, and then the cover glass and the tube are removed to form a columnar resin in which the toner particles are embedded in the outermost surface. The cross section of the toner particle is obtained by cutting through a length equal to the radius of the toner particle (for example, 4.0 μm when the weight average particle diameter (D4) is 8.0 μm) from the outermost surface of the columnar resin at a cutting speed of 0.6 mm/s with an ultrasonic ultramicrotome (Leica Microsystems, UC7). Next, cutting is performed to have a film thickness of 250 nm, and a thin sample of the cross section of the toner particle is produced. By cutting in this way, it is possible to obtain a cross section of the central part of the toner particle.

The obtained thin sample is stained for 15 min in a $RuO_4$ gas atmosphere at 500 Pa by using a vacuum electron staining apparatus (Filgen, Inc., VSC 4 R1H), and TEM observations are performed using a STEM function of a TEM (JEOL Ltd., JEM 2800).

An image is acquired with a STEM probe size of 1 nm and an image size of 1024×1024 pixels. Also, an image is acquired by adjusting Contrast of the Detector Control panel of the bright field image to 1425, Brightness to 3750, Contrast of the Image Control panel to 0.0, Brightness to 0.5, and Gamma to 1.00.

<Measurement of Area Proportion of Domains of Release Agent>

Areas of the release agent domains A and B in the toner particle cross section are calculated using image processing software (Image Pro PLUS) on the basis of the above-described TEM observation of the ruthenium-stained toner particle cross section. When there is a plurality of release agent domains, the areas are added up. This is done for cross sections of at least 100 toner particles, and the area proportions of the release agent domains A and B per one toner particle are obtained by the following formulas.

Area proportion of domain $A$ ($SA$)="total area of domain $A$"/"area of toner particle cross section"×100 (area %)

Area proportion of domain $B$ ($SB$)="total area of domain $B$"/"area of toner particle cross section"×100 (area %)

<Measurement of Amount of Tetrahydrofuran (THF) Insolubles in Toner Resin Component>

A total of 1.0 g of the toner is weighed (W1 g) and loaded in a cylindrical filter paper (No. 86R (trade name) manufactured by Toyo Roshi Kaisha, Ltd.), and Soxhlet extraction is performed. The extraction is performed for 20 h with 200 mL of THF as a solvent, the soluble component extracted with the solvent is concentrated, vacuum drying is then performed for several hours at 40° C., and the amount of the THF soluble resin component is weighed (W2 g). The mass of components other than the resin component, such as the colorant, in the toner is taken as (W3 g). The amount of the THF insolubles is determined from the following formula.

The amount (% by mass) of the THF insolubles=$\{W1-(W3+W2))/(W1-W3)\}\times 100$

EXAMPLES

Basic configuration and features of the present invention are described hereinabove, but the present invention will be specifically described below on the basis of examples. However, the embodiments of the present invention are not limited at all by these examples. "Parts" and "%" described in the Examples are all on a mass basis unless specified otherwise.

<Fabrication of Toner Carrying Member 1>

(Preparation of Substrate 1)

A substrate 1 was prepared by coating a primer (trade name DY 35-051; manufactured by Dow Corning Toray Co., Ltd.) on a core made of SUS 304 and having a diameter of 6 mm and baking.

(Fabrication of Elastic Roller 1)

The substrate 1 prepared as described above was placed in a mold and an addition type silicone rubber composition in which the following materials were mixed was injected into a cavity formed in the mold.

| | |
|---|---|
| Liquid silicone rubber material (trade name SE6724A/B; manufactured by Dow Corning Toray Co, Ltd.) | 100 parts |
| Carbon black (trade name Toka Black #4300; manufactured by Tokai Carbon Co., Ltd.) | 15 parts |
| Silica particles as a heat resistance imparting agent | 0.2 parts |
| Platinum catalyst | 0.1 parts |

The mold was then heated and the silicone rubber was cured by vulcanizing for 15 min at a temperature of 150° C. The substrate 1 having the cured silicone rubber layer formed on the peripheral surface thereof was removed from the metal mold, and the substrate 1 was then further heated for 1 h at a temperature of 180° C. to complete the curing reaction of the silicone rubber layer. Thus, an elastic roller 1 having a silicone rubber elastic layer with a diameter of 12 mm formed so as to cover the outer peripheral surface of the substrate was fabricated.

(Preparation of Surface Layer 1)

(Synthesis of Isocyanate Group-Terminated Prepolymer 1)

A total of 100.0 g of polypropylene glycol polyol (trade name Excenol 4030; manufactured by Asahi Glass Co., Ltd.) was gradually added dropwise to 17.7 parts of tolylene diisocyanate (TDI) (trade name Cosmonate T80; manufactured by Mitsui Chemicals, Inc.) in a reaction vessel while maintaining the temperature inside the reaction vessel at 65° C. After completion of the dropwise addition, the reaction was carried out for 2 h at a temperature of 65° C. The obtained reaction mixture was cooled to room temperature to obtain an isocyanate group-terminated prepolymer 1 having an isocyanate group amount of 3.8% by mass.

(Synthesis of Amino Compound 1)

A total of 100.0 parts (1.67 mol) of ethylenediamine and 100 parts of pure water were heated to 40° C. while stirring in a reaction vessel equipped with a stirrer, a thermometer, a reflux pipe, a dropping device and a temperature adjusting device. Then, 425.3 parts (7.35 mol) of propylene oxide was gradually added dropwise over 30 min while maintaining the reaction temperature at not more than 40° C. The reaction was further performed by stirring for 1 h to obtain a reaction mixture. The resulting reaction mixture was heated under reduced pressure to distil off water and obtain 426 g of amino compound 1.

The following materials for the surface layer were stirred and mixed.

| | |
|---|---|
| Isocyanate group-terminated prepolymer 1 | 617.9 parts |
| Amino compound 1 | 34.2 parts |

-continued

| | |
|---|---|
| Carbon black (trade name MA 230; manufactured by Mitsubishi Chemical Corporation) | 117.4 parts |
| Fine particles of urethane resin (trade name Art Pearl C-400; manufactured by Negami Chemical Industrial Co., Ltd.) | 130.4 parts |

Next, methyl ethyl ketone (also referred to hereinbelow as "MEK") was added so that the total solid fraction ratio was 30% by mass, followed by mixing with a sand mill. Then, the viscosity was adjusted to at least 10 cps and not more than 13 cps with MEK to prepare a coating material for forming a surface layer.

The elastic roller 1 which was fabricated in advance was immersed in the coating material for forming a surface layer to form a coating film of the coating material on the surface of the elastic layer of the elastic roller 1, followed by drying. Further, a surface layer having a film thickness of 15 μm was provided on the outer periphery of the elastic layer by heat treatment for 1 h at a temperature of 150° C. to fabricate a toner carrying member 1.

<Production Example of Amorphous Polyester APES 1>

A carboxylic acid component and an alcohol component prepared as shown in Table 1 were placed as raw material monomers in a reaction vessel equipped with a nitrogen introducing tube, a dewatering tube, a stirrer, and a thermocouple, and then 1.5 parts of dibutyltin as a catalyst was added with respect to 100 parts of a total amount of the monomers. The temperature was then quickly raised to 180° C. under a normal pressure in a nitrogen atmosphere, and then water was distilled off and polycondensation was performed while heating from 180° C. to 210° C. at a rate of 10° C./h. After reaching 210° C., the interior of the reaction vessel was depressurized to not more than 5 kPa, and polycondensation was performed under conditions of 210° C. and not more than 5 kPa to obtain an amorphous polyester APES 1. At that time, the polymerization time was adjusted so that the peak molecular weight of the obtained amorphous polyester APES 1 would assume the value shown in Table 1. Physical properties of the amorphous polyester APES 1 are shown in Table 1.

<Production Examples of Amorphous Polyesters APES 2 to 14>

Amorphous polyesters APES 2 to 14 were obtained in the same manner as the amorphous polyester APES 1, except that the raw material monomers and the amounts used were changed as shown in Table 1. Physical properties of these amorphous polyesters are shown in Table 1.

<Production Example of Amorphous Polyester APES 15>

A total of 100 g of bisphenol A ethylene oxide 2 mol adduct, 189 g of bisphenol A propylene oxide 2 mol adduct, 51 g of terephthalic acid, 61 g of fumaric acid, 25 g of adipic acid, and 2 g of an esterification catalyst (tin octylate) were placed in a four-neck flask equipped with a nitrogen introducing tube, a dewatering tube, a stirrer, and a thermocouple, a polycondensation reaction was performed for 8 h at 230° C., and the reaction was further performed for 1 h at 8 kPa, followed by cooling to 160° C. Then, a mixture of 6 g of acrylic acid, 70 g of styrene, 31 g of n-butyl acrylate, and 20 g of a polymerization initiator (di-t-butyl peroxide) was added dropwise over 1 hour through a dropping funnel. After the dropwise addition, the addition polymerization reaction was continued for 1 h while maintaining the temperature at 160° C., and the temperature was then raised to 200° C. and held for 1 h at 10 kPa. The unreacted acrylic acid, styrene, and butyl acrylate were thereafter removed to obtain an amorphous polyester (APES 15) which was a composite resin formed by bonding a vinyl polymer segment and a polyester polymerized segment.

[Table 1]

TABLE 1

Physical properties of amorphous polyesters

| Amorphous polyester APES No. | Alcohol component (mol parts) Bisphenol A - PO 2 mol adduct | Carboxylic acid component (mol parts) Terephthalic acid | Trimellitic anhydride | Fumaric acid (C4) | Adipic acid (C6) | Dodecanedioic acid (C12) | Stearic acid |
|---|---|---|---|---|---|---|---|
| 1 | 100 | 67 | 3 | 0 | 20 | 0 | 10 |
| 2 | 100 | 67 | 5 | 0 | 19 | 0 | 9 |
| 3 | 100 | 67 | 6 | 0 | 19 | 0 | 8 |
| 4 | 100 | 68 | 1 | 0 | 22 | 0 | 9 |
| 5 | 100 | 66 | 1 | 0 | 25 | 0 | 8 |
| 6 | 100 | 66 | 0 | 0 | 26 | 0 | 8 |
| 7 | 100 | 66 | 8 | 0 | 26 | 0 | 0 |
| 8 | 100 | 76 | 4 | 0 | 0 | 10 | 10 |
| 9 | 100 | 42 | 4 | 50 | 0 | 0 | 4 |
| 10 | 100 | 38 | 4 | 55 | 0 | 0 | 3 |
| 11 | 100 | 62 | 5 | 0 | 30 | 0 | 3 |
| 12 | 100 | 72 | 2 | 0 | 16 | 0 | 10 |
| 13 | 100 | 51 | 5 | 0 | 35 | 0 | 9 |
| 14 | 100 | 95 | 5 | 0 | 0 | 0 | 0 |
| 15 | Described in the main text | | | | | | |

| Amorphous polyester APES No. | Carboxylic acid component/Alcohol component (mol ratio) | Acid value (mg KOH/mg) | Hydroxyl value (mg KOH/mg) | Tm (° C.) | Peak top molecular weight (Mp) |
|---|---|---|---|---|---|
| 1 | 0.88 | 6.0 | 20 | 95 | 10000 |
| 2 | 0.88 | 10.0 | 25 | 96 | 10200 |

TABLE 1-continued

| Physical properties of amorphous polyesters | | | | | |
|---|---|---|---|---|---|
| 3 | 0.88 | 12.0 | 28 | 94 | 9900 |
| 4 | 0.88 | 1.0 | 26 | 96 | 10200 |
| 5 | 0.88 | 0.5 | 30 | 96 | 10200 |
| 6 | 0.88 | 0.1 | 32 | 97 | 10300 |
| 7 | 0.88 | 15.0 | 43 | 98 | 10500 |
| 8 | 0.93 | 7.0 | 24 | 87 | 13000 |
| 9 | 0.82 | 8.0 | 40 | 82 | 7800 |
| 10 | 0.81 | 9.0 | 40 | 80 | 7500 |
| 11 | 0.85 | 9.0 | 30 | 90 | 9200 |
| 12 | 0.90 | 4.0 | 20 | 102 | 11000 |
| 13 | 0.82 | 9.0 | 38 | 85 | 8100 |
| 14 | 0.88 | 7.0 | 50 | 120 | 10000 |
| 15 | Described in the main text | | | | |

<Production Example of Treated Magnetic Body>

A caustic soda solution in an equivalent amount of 1.00 to 1.10 with respect to the iron element, $P_2O_5$ in an amount of 0.15% by mass in terms of the phosphorus element with respect to the iron element, and $SiO_2$ in an amount of 0.50% by mass in terms of the silicon element with respect to the iron element were mixed in the aqueous solution of ferrous sulfate to prepare an aqueous solution including ferrous hydroxide. The pH of the aqueous solution was set to 8.0, and an oxidation reaction was performed at 85° C. while blowing air to prepare a slurry having seed crystals.

An aqueous solution of ferrous sulfate was then added to the slurry to obtain a 0.90 to 1.20 equivalent with respect to the initial amount of alkali (the sodium component of caustic soda), the slurry was maintained at pH 7.6, and an oxidation reaction was advanced while blowing air to obtain a slurry including magnetic iron oxide. After filtering and washing, the water-containing slurry was taken out. At this time, a small amount of water-containing sample was sampled and the water content was measured. Then, the water-containing sample was charged, without drying, into another aqueous medium, and was stirred and redispersed with a pin mill while circulating the slurry, and the pH of the redispersion was adjusted to about 4.8. Then, 1.6 parts of n-hexyltrimethoxysilane coupling agent was added to 100 parts of magnetic iron oxide (the amount of magnetic iron oxide was calculated as a value obtained by subtracting the water content from the water-containing sample) and hydrolysis was performed. Then, sufficient stirring was performed, and the surface treatment was performed with the pH of the dispersion set at 8.6. The produced hydrophobic magnetic body was filtered with a filter press, washed with a large amount of water, dried for 15 min at 100° C., and dried for 30 min at 90° C. The obtained particles were deagglomerated to obtain a treated magnetic material having a volume average particle diameter of 0.21 μm.

<Production Example of Toner Base Particle 1>

A total 450 parts of 0.1 mol/L-$Na_3PO_4$ aqueous solution was charged into 720 parts of ion-exchanged water and heated to 60° C. Then, 67.7 parts of a 1.0 mol/L-$CaCl_2$ aqueous solution was added to obtain an aqueous medium including a dispersion stabilizer.

| | |
|---|---|
| Styrene | 75.0 parts |
| N-butyl acrylate | 25.0 parts |
| Amorphous polyester APES 1 | 10.0 parts |
| Divinylbenzene | 0.40 parts |
| Iron complex of monoazo dye (T-77: manufactured by Hodogaya Chemical Co, Ltd.) | 1.5 parts |
| Treated magnetic body | 65.0 parts |

The above formulation was uniformly dispersed and mixed using an attritor (Mitsui Miike Chemical Engineering Machinery Co., Ltd.) to obtain a monomer composition. This monomer composition was heated to 65° C., 12 parts of paraffin wax (hydrocarbon wax) (melting point 78° C.) and 3 parts of ester wax (melting point 72° C.) were added, mixed and dissolved. Then, 5.0 parts of tert-butyl peroxypivalate as a polymerization initiator was dissolved.

The monomer composition was charged into the aqueous medium and stirred and granulated for 10 min at 12,000 rpm in a T.K. Homomixier (manufactured by Tokushu Kika Kogyo Co., Ltd.) at 60° C. under a $N_2$ atmosphere. The reaction was then performed for 4 h at 70° C. while stirring with a paddle stirring blade. After completion of the reaction, it was confirmed that colored particles were dispersed in the aqueous medium obtained herein, and that calcium phosphate has adhered as an inorganic dispersing agent to the surface of the colored particles.

At this point of time, hydrochloric acid was added to the aqueous medium to wash and remove the calcium phosphate, followed by filtration, drying and analysis of the colored particles. As a result, the glass transition temperature Tg of the binder resin was 55° C.

The temperature of the aqueous medium in which the colored particles were dispersed was then raised to 100° C. and held for 120 min. Water at 5° C. was then charged into the aqueous medium, and the aqueous medium was cooled from 100° C. to 50° C. at a cooling rate of 300° C./min. The aqueous medium was then kept for 120 min at 50° C.

Toner base particles 1 were then obtained by adding hydrochloric acid to the aqueous medium to wash and remove the calcium phosphate and then filtering and drying. The production conditions of the toner base particle 1 are shown in Tables 2-1 to 2-4.

<Production Example of Toner Base Particles 2 to 39>

Toner base particles 2 to 39 were produced in the same manner as in the production of the toner base particles 1, except that the type and amount added of the amorphous polyester, the type and amount added of the coloring agent, the amount of the initiator added, the amount of the release agent added, and the production conditions were changed. The production conditions of the obtained toner base particles are shown in Tables 2-1 to 2-4.

<Production-Example of Toner Base Particles 40>

<<Preparation of Dispersions>>

—Resin Particle Dispersion (1)—

| | |
|---|---|
| Styrene (manufactured by Wako Pure Chemical Industries, Ltd.) | 325 parts |

-continued

| | |
|---|---|
| N-butyl acrylate (manufactured by Wako Pure Chemical Industries, Ltd.) | 100 parts |
| Acrylic acid (manufactured by Rhodia Nicca, Ltd.) | 13 parts |
| 1,10-Decanediol diacrylate (manufactured by Shin-Nakamura Chemical Co., Ltd.) | 1.5 parts |
| Dodecanethiol (manufactured by Wako Pure Chemical Industries, Ltd.) | 3.0 parts |

The above-mentioned components were mixed in advance and dissolved to prepare a solution, and a surfactant solution prepared by dissolving 9 parts of an anionic surfactant (Dowfax A211, manufactured by The Dow Chemical Company) in 580 parts of ion-exchanged water was accommodated in a flask, 400 parts of the solution of the above-mentioned components was charged therein, dispersed and emulsified, and 50 parts of ion-exchanged water having 6 parts of ammonium persulfate dissolved therein was charged while slowly stirring and mixing for 10 min.

The atmosphere inside the flask was then sufficiently replaced with nitrogen, the flask was heated with an oil bath under stirring until the temperature inside the flask reached 75° C., and the emulsion polymerization was continued as it was for 5 h to obtain a resin particle dispersion (1).

The resin particles were separated from the resin particle dispersion (1) and physical properties thereof were examined. The number average particle diameter was 195 nm, the amount of solids in the dispersion was 42%, the glass transition point was 51.5° C., and the weight average molecular weight Mw was 32,000.

—Resin Particle Dispersion (2)—

The amorphous polyester (APES 18) was dispersed using a Cavitron CD1010 disperser (manufactured by EuroTec) modified to a high temperature and high pressure. Specifically, a composition with a concentration ratio of 79% of ion-exchanged water, 1% (as an active component)of NEOGEN R-K anionic surfactant (Daiichi Kogyo Seiyaku Co., Ltd.), and 20% of the amorphous polyester 18 was adjusted to a pH to 8.5 with ammonia, and the Cavitron was operated under the conditions of a rotor rotation speed of 60 Hz, a pressure of 5 kg/cm$^2$, and heating at 140° C. with a heat exchanger to obtain a resin fine particle dispersion (2) having a number average particle diameter of 200 nm.

—Colorant Dispersion—

| | |
|---|---|
| Carbon black | 20 parts |
| NEOGEN R-K anionic surfactant (Daiichi Kogyo Seiyaku Co., Ltd.) | 2 parts |
| Ion-exchanged water | 78 parts |

The above components were mixed as a pigment with water for 2 min at 3000 rpm by using a homogenizer (Ultra Turrax T50, manufactured by IKA Works, Inc.), dispersed for 10 min at 5000 rpm, and then stirred for 1 day and night with a conventional stirrer to remove bubbles. A colorant dispersion (1) was then obtained by using a high-pressure impact type disperser Ultimizer (HJP 30006, manufactured by Sugino Machine Limited) for about 1 h at a pressure of 240 MPa. The pH of the dispersion was then adjusted to 6.5.

—Release Agent Dispersion—

| | |
|---|---|
| Hydrocarbon wax (Fischer-Tropsch wax, maximum endothermic peak = 78° C., Mw = 750) | 45 parts |
| NEOGEN R-K anionic surfactant (Daiichi Kogyo Seiyaku Co., Ltd.) | 5 parts |
| Ion-exchanged water | 200 parts |

The above components were heated to 95° C., sufficiently dispersed with a homogenizer (Ultra Turrax T50, manufactured by IKA Works, Inc.), and dispersed with a pressure discharge type Gaulin homogenizer to obtain a release agent dispersion having a number average diameter of 190 nm and an amount of solids of 25%.

<<Production Example of Toner Base Particles 40>>

| | |
|---|---|
| Ion-exchange water | 400 parts |
| Resin particle dispersion (1) | 620 parts (resin particle concentration: 42%) |
| Resin particle dispersion (2) | 279 parts (resin particle concentration: 20%) |
| NEOGEN R-K anionic surfactant (Daiichi Kogyo Seiyaku Co., Ltd.) (active component amount 60%) | 1.5 parts (0.9 parts as an active component) |

The above components were placed in a 3 L reaction vessel equipped with a thermometer, a pH meter, and a stirrer, and maintained for 30 min at a temperature of 30° C. and a stirring rotation speed of 150 rpm while controlling the temperature with a mantle heater from the outside. Then, 88 parts of the colorant dispersion and 60 parts of the release agent dispersion were charged, followed by holding for 5 min. A 1.0% nitric acid aqueous solution was added in this state to adjust the pH to 3.0. The stirrer and the mantle heater were then removed, ½ of a mixed solution of 0.33 parts of polyaluminum chloride and 37.5 parts of a 0.1% nitric acid aqueous solution was added while dispersing at 3000 rpm with a homogenizer (Ultra Turrax T50 manufactured by IKA Japan K.K.), the dispersion rotation speed was then set to 5000 rpm, the remaining ½ of the solution was added over 1 min, the dispersion rotation speed was set to 6500 rpm, and dispersion was performed for 6 min.

The stirrer and mantle heater were installed at the reaction vessel, and the temperature was raised to 42° C. at 0.5° C./min while appropriately adjusting the rotation speed of the stirrer so that the slurry was sufficiently stirred, followed by holding for 15 min at 42° C. After holding, the particle size was measured with a Coulter Multisizer every 10 min while raising the temperature at 0.05° C./min. When the weight average particle diameter reached 7.8 μm, the pH was brought to 9.0 with a 5% sodium oxide aqueous solution. The temperature was then raised to 96° C. at a heating rate of 1° C./min while adjusting the pH to 9.0 every 5° C., followed by holding at 96° C. When the particle shape and surface properties were observed with an optical microscope and a scanning electron microscope (FE-SEM) every 30 min, the particles became substantially spherical at 2 h, and the temperature was lowered to 20° C. at 1° C./min to solidify the particles.

The reaction product was then filtered and washed in a flow of ion-exchanged water. When the conductivity of the filtrate became not more than 50 mS, the cake-like mparticles were taken out, charged into ion-exchanged water taken in an amount 10 times the particle weight, and stirred with a three-one motor, and when the particles became sufficiently loose, the pH was adjusted to 3.8 with a 1.0% nitric acid aqueous solution, followed by holding for 10 min. The filtration and washing in water flow were then performed again, and when the conductivity of the filtrate became not more than 10 mS, the flow of water was stopped and solid-liquid separation was performed. The obtained cake-like particles were deagglomerated with a sample mill and dried for 24 h in an oven at 40° C. Further, the resultant powder was deagglomerated with a sample mill and then subjected to additional vacuum drying for 5 h in an oven at 40° C. to obtain toner base particles 40.

TABLE 2-1

| Toner | Amorphous polyester | | Colorant | | Release agent 1 (hydro-carbon wax) | Release agent 2 (ester wax) | Initiator | Cross-linking agent | Holding time at 100° C. after poly- | Rate of cooling to temperature (50° C.) not more than | Holding time at temperature (50° C.) not more than |
|---|---|---|---|---|---|---|---|---|---|---|---|
| base particle No. | No. | Amount added (parts) | Type | Amount added (parts) | Amount added (parts) | Amount added (parts) | Amount added (parts) | Amount added (parts) | merization step (min) | Tg of toner (° C./min) | Tg of toner (min) |
| 1 | APES1 | 10 | Treated magnetic body 1 | 65 | 12 | 3 | 5 | 0.40 | 120 | 300 | 120 |
| 2 | APES1 | 10 | Treated magnetic body 1 | 65 | 12 | 3 | 5 | 0.20 | 120 | 200 | 120 |
| 3 | APES1 | 10 | Treated magnetic body 1 | 65 | 12 | 3 | 5 | 0.18 | 120 | 100 | 120 |
| 4 | APES1 | 10 | Treated magnetic body 1 | 65 | 12 | 3 | 5 | 0.50 | 120 | 400 | 120 |
| 5 | APES1 | 10 | Treated magnetic body 1 | 65 | 12 | 3 | 5 | 0.52 | 120 | 500 | 120 |
| 6 | APES1 | 10 | Treated magnetic body 1 | 65 | 9 | 3 | 5 | 0.40 | 120 | 500 | 30 |
| 7 | APES1 | 10 | Treated magnetic body 1 | 65 | 9 | 3 | 5 | 0.40 | 120 | 500 | 10 |
| 8 | APES1 | 10 | Treated magnetic body 1 | 65 | 15 | 3 | 5 | 0.40 | 120 | 100 | 180 |
| 9 | APES1 | 10 | Treated magnetic body 1 | 65 | 15 | 3 | 5 | 0.40 | 120 | 100 | 240 |
| 10 | APES1 | 10 | Treated magnetic body 1 | 65 | 7 | 3 | 5 | 0.40 | 120 | 400 | 60 |

TABLE 2-2

| Toner | Amorphous polyester | | Colorant | | Release agent 1 (hydro-carbon wax) | Release agent 2 (ester wax) | Initiator | Cross-linking agent | Holding time at 100° C. after poly- | Rate of cooling to temperature (50° C.) not more than | Holding time at temperature (50° C.) not more than |
|---|---|---|---|---|---|---|---|---|---|---|---|
| base particle No. | No. | Amount added (parts) | Type | Amount added (parts) | Amount added (parts) | Amount added (parts) | Amount added (parts) | Amount added (parts) | merization step (min) | Tg of toner (° C./min) | Tg of toner (min) |
| 11 | APES1 | 10 | Treated magnetic body 1 | 65 | 7 | 3 | 5 | 0.40 | 120 | 400 | 30 |
| 12 | APES1 | 10 | Treated magnetic body 1 | 65 | 15 | 3 | 5 | 0.40 | 120 | 300 | 120 |
| 13 | APES1 | 10 | Treated magnetic body 1 | 65 | 17 | 3 | 5 | 0.40 | 120 | 300 | 120 |
| 14 | APES2 | 15 | Treated magnetic body 1 | 65 | 12 | 3 | 5 | 0.40 | 120 | 300 | 120 |

TABLE 2-2-continued

| Toner | Amorphous polyester | | Colorant | | Release agent 1 (hydro-carbon wax) | Release agent 2 (ester wax) | Initiator | Cross-linking agent | Holding time at 100° C. after poly- | Rate of cooling to temperature (50° C.) not more than | Holding time at temperature (50° C.) not more than |
|---|---|---|---|---|---|---|---|---|---|---|---|
| base particle No. | No. | Amount added (parts) | Type | Amount added (parts) | Amount added (parts) | Amount added (parts) | Amount added (parts) | Amount added (parts) | merization step (min) | Tg of toner (° C./min) | Tg of toner (min) |
| 15 | APES3 | 15 | Treated magnetic body 1 | 65 | 12 | 3 | 5 | 0.40 | 120 | 300 | 120 |
| 16 | APES4 | 7 | Treated magnetic body 1 | 65 | 12 | 3 | 5 | 0.40 | 60 | 300 | 120 |
| 17 | APES4 | 5 | Treated magnetic body 1 | 65 | 12 | 3 | 5 | 0.40 | 30 | 300 | 120 |
| 18 | APES5 | 5 | Treated magnetic body 1 | 65 | 12 | 3 | 5 | 0.40 | 120 | 309 | 120 |
| 19 | APES4 | 4 | Treated magnetic body 1 | 65 | 12 | 3 | 5 | 0.40 | 30 | 300 | 120 |
| 20 | APES6 | 5 | Treated magnetic body 1 | 65 | 12 | 3 | 5 | 0.40 | 30 | 300 | 120 |

TABLE 2-3

| Toner | Amorphous polyester | | Colorant | | Release agent 1 (hydro-carbon wax) | Release agent 2 (ester wax) | Initiator | Cross-linking agent | Holding time at 100° C. after poly- | Rate of cooling to temperature (50° C.) not more than | Holding time at temperature (50° C.) not more than |
|---|---|---|---|---|---|---|---|---|---|---|---|
| base particle No. | No. | Amount added (parts) | Type | Amount added (parts) | Amount added (parts) | Amount added (parts) | Amount added (parts) | Amount added (parts) | merization step (min) | Tg of toner (° C./min) | Tg of toner (min) |
| 21 | APES7 | 10 | Treated magnetic body 1 | 65 | 12 | 3 | 5 | 0.40 | 120 | 300 | 120 |
| 22 | APES7 | 10 | Treated magnetic body 1 | 65 | 17 | 3 | 5 | 0.40 | 120 | 500 | 10 |
| 23 | APES8 | 10 | Treated magnetic body 1 | 65 | 12 | 3 | 5 | 0.40 | 120 | 300 | 120 |
| 24 | APES9 | 10 | Treated magnetic body 1 | 65 | 12 | 3 | 5 | 0.40 | 120 | 300 | 120 |
| 25 | APES10 | 10 | Treated magnetic body 1 | 65 | 12 | 3 | 5 | 0.40 | 120 | 300 | 120 |
| 26 | APES1 | 20 | Treated magnetic body 1 | 65 | 12 | 13 | 5 | 0.40 | 120 | 300 | 120 |
| 27 | APES1 | 25 | Treated magnetic body 1 | 65 | 12 | 3 | 5 | 0.40 | 120 | 300 | 120 |
| 28 | APES11 | 10 | Treated magnetic body 1 | 65 | 12 | 3 | 4 | 0.45 | 120 | 300 | 120 |
| 29 | APES12 | 10 | Treated magnetic body 1 | 65 | 15 | — | 7 | 0.38 | 120 | 300 | 120 |
| 30 | APES13 | 30 | Treated magnetic body | 65 | 12 | 3 | 5 | 0.40 | 120 | 300 | 120 |

TABLE 2-4

| Toner base particle No. | Amorphous polyester No. | Amorphous polyester Amount added (parts) | Colorant Type | Colorant Amount added (parts) | Release agent 1 (hydro-carbon wax) Amount added (parts) | Release agent 2 (ester wax) Amount added (parts) | Initiator Amount added (parts) | Cross-linking agent Tg of added (parts) | Holding time at 100° C. after poly-merization step (min) | Rate of cooling to temperature (50° C.) not more than Tg of toner (° C./min) | Holding time at temperature (50° C.) not more than Tg of toner (min) |
|---|---|---|---|---|---|---|---|---|---|---|---|
| 31 | APES1 | 10 | Treated magnetic body 1 | 65 | 9 | 6 | 7 | 0.40 | 120 | 300 | 120 |
| 32 | APES1 | 7 | Treated magnetic body 1 | 65 | 12 | 3 | 4 | 0.48 | 120 | 300 | 120 |
| 33 | APES1 | 10 | Carbon black | 8 | 12 | 3 | 5 | 0.40 | 120 | 300 | 120 |
| 34 | APES1 | | Carbon black | 8 | 12 | 3 | 5 | 0.40 | 120 | 300 | 120 |
| 35 | APES1 | 20 | Carbon black | 8 | 12 | 3 | 5 | 0.40 | 120 | 300 | 120 |
| 36 | APES1 | 10 | Treated magnetic body 1 | 65 | 15 | — | 4 | 0.50 | 120 | 300 | 120 |
| 37 | APES1 | 10 | Treated magnetic body 1 | 65 | 15 | 10 | 7 | 0.70 | 120 | 300 | 120 |
| 38 | APES1 | 10 | Treated magnetic body 1 | 65 | 15 | 10 | 7 | 0.55 | 120 | 300 | 120 |
| 39 | APES14 | 10 | Treated magnetic body 1 | 95 | 15 | — | 5 | 0.40 | 120 | 5 | 30 |
| 40 | Described in the main text | | | | | | | | | | |

*Carbon black: MA-100 (manufactured by Mitsubishi Chemical Corporation)
*Initiator: tert-butyl peroxypivalate
*Crosslinking agent: divinylbenzene

Example 1

<Production of Toner>

<Production Example of Toner 1>

A total of 0.3 parts of sol-gel silica fine particles having a primary particle diameter of 115 nm was added to 100 parts of the toner base particles 1, and mixing was performed using a Henschel mixer (Mitsui Miike Chemical Engineering Machinery Co., Ltd.). Then, 0.9 parts of hydrophobic silica fine particles prepared by treating silica which had a primary particle diameter of 12 nm with hexamethyldisilazane and then treating with silicone oil and having a BET specific surface area value of 120 $m^2/g$ after the treatment was added to the mixture and mixing was performed in the same manner by using the Henschel mixer (Mitsui Miike Chemical Engineering Machinery Co., Ltd.) to prepare a toner 1. Physical properties of the toner 1 are shown in Table 3-1 and Table 3-2.

<Image Forming Apparatus>

A Canon printer LBP7700C was modified and used for image output evaluation. The modification involved changing the toner carrying member into the toner carrying member 1, rotating the toner supply member of the developing device reversely to the toner carrying member, as shown in FIG. 1, and turning off voltage application to the toner supply member. The contact pressure was adjusted so that the width of the contact region between the toner carrying member and the electrostatic latent image bearing member was 1.0 mm.

The modification also involved the removal of the cleaning blade, as depicted in FIG. 2, and setting the process speed to 33 ppm. In this way, strict image forming conditions were set as a result of reducing the area of the contact region between the toner carrying member and the electrostatic latent image bearing member and increasing the process speed. As additional modification, the fixing device was removed from the image forming apparatus to enable a flow of unfixed images. The applied voltage was then adjusted so that the toner placed amount in a solid image became 0.9 $mg/cm^2$.

The evaluation paper used at this time was Canon A4 size OceRedLabel paper (basis weight 80 $g/m^2$).

A total of 100 g of toner 1 was loaded in the developing device modified as described above, and white spots and density unevenness under a normal-temperature and normal-humidity environment (23.0° C./55% RH) and white spots under a normal-temperature and high-humidity environment (23.0° C./85% RH) were evaluated. The repeated use test was then performed by changing the environment to a low-temperature and low-humidity environment (15.0° C./10% RH). As an output image for the repeated use test, a horizontal line image with a print percentage of 1% was printed on 4000 sheets by two sheets intermittently. The evaluation results are shown in Table 4-1 and Table 4-2. Here, Business 4200 (manufactured by Xerox Corporation) having a basis weight of 75 $g/m^2$ was used as the evaluation paper used in the repeated use test.

Evaluation methods and criteria for evaluation of each evaluation item performed in Examples and Comparative Examples of the present invention are described below.

[White Spots]

The evaluation image was a solid image on Canon A4 size OceRedLabel paper (basis weight 80 g/m$^2$), and the image was adjusted to have a margin of 80 mm on the left and right sides and 10 mm on the top and bottom. With this adjusted image, presence or absence of white spots at each fixing temperature was visually confirmed while varying the set temperature by 5° C. in the fixing temperature range from 185° C. to 195° C. A rubbing resistance test was performed with respect to a fixed image in which no white spots occurred. The rubbing condition was rubbing 5 times with Silbon paper under a load of 50 g/cm$^2$.

The evaluation was performed according to the following criteria.

Evaluation of white spots (lower limit temperature at which white spots did not occur) (at least C was determined to be satisfactory)

A: White spots did not occur at 185° C.
B: White spots did not occur at 190° C.
C: White spots did not occur at 195° C.
D: White spots occurred even at 195° C.

The results of the rubbing resistance test (at least B is determined to be satisfactory) in the image at the lower limit temperature at which white spots did not occur A: No peeling even if rubbed.
B: Slight peeling.
C: Peel off.

[Density Unevenness]

A full-surface halftone image was formed as an evaluation image on Canon A4 size OceRedLabel paper (basis weight 80 g/m$^2$). The set temperature of the fixing device was changed according to the evaluation toner and obtained by adding 10° C. to the lower limit temperature at which white spots did not occur in the white spot evaluation of each toner. It was visually determined whether there was density unevenness on this halftone image. In the present invention, at least C was determined to be satisfactory.

A: No density unevenness occurred.
B: Density unevenness occurs very slightly.
C: Density unevenness occurs, but it is not that conspicuous.
D: Density unevenness occurs all over and is conspicuous.

<Fogging on Drum after Black>

Measurement of fogging was performed using Reflectmeter Model TC-6DS manufactured by Tokyo Denshoku Co., Ltd. A green filter was used. "Fogging on Drum After Black" was determined after 2000 prints and after 4000 prints by outputting a solid black image in the repeated use test, using a Mylar tape for taping and peeling off the area of the photosensitive drum corresponding to a white background portion (non-image area) immediately after the transfer of a solid black image, and sticking the Mylar tape to the paper. A difference was calculated by subtracting the reflectance in the case where only the Mylar tape was stuck on unused paper from the reflectance in the case where the peeled-off Mylar tape was stuck on unused paper.

In the present invention, at least C was determined to be satisfactory.

A: less than 5.0%
B: at least 5.0% and less than 10.0%
C: at least 10.0% and less than 20.0%
D: at least 20.0%

Examples 2 to 35

In the production example of toner 1, the toner base particles were changed as shown in Table 3-1 and Table 3-2, to obtain toners 2 to 35. Physical properties of each toner are shown in Table 3-1 and Table 3-2. The evaluation results obtained in the same manner as in Example 1 are shown in Table 4-1 and Table 4-2.

Comparative Examples 1 to 5

In the production example of toner 1, the toner base particles were changed as shown in Table 3-1 and Table 3-2, to obtain toners 36 to 40. Physical properties of each toner are shown in Table 3-1 and Table 3-2. The evaluation results obtained in the same manner as in Example 1 are shown in Table 4-1 and Table 4-2.

TABLE 3-1

Physical properties of toners

| Toner No. | Toner base particles No. | D4 of toner (μm) | Average circularity | Tg of toner (° C.) | Peak molecular weight of toner particle (Mp) | Temperature T (° C.) | Slope of area increasing rate | Toner softening point (° C.) | S211/S85 |
|---|---|---|---|---|---|---|---|---|---|
| 1 | 1 | 8.0 | 0.975 | 55 | 22000 | 101 | 0.040 | 125 | 2.00 |
| 2 | 2 | 8.0 | 0.974 | 54 | 23000 | 97 | 0.045 | 120 | 2.05 |
| 3 | 3 | 8.1 | 0.973 | 53 | 23000 | 96 | 0.050 | 118 | 2.10 |
| 4 | 4 | 8.0 | 0.974 | 55 | 21000 | 105 | 0.035 | 131 | 1.95 |
| 5 | 5 | 8.0 | 0.975 | 54 | 21000 | 107 | 0.033 | 133 | 1.93 |
| 6 | 6 | 8.1 | 0.974 | 55 | 22000 | 102 | 0.039 | 128 | 2.00 |
| 7 | 7 | 7.9 | 0.973 | 55 | 22000 | 103 | 0.038 | 130 | 2.00 |
| 8 | 8 | 8.0 | 0.972 | 55 | 22000 | 100 | 0.041 | 124 | 2.00 |
| 9 | 9 | 7.9 | 0.971 | 55 | 22000 | 99 | 0.042 | 123 | 2.00 |
| 10 | 10 | 8.1 | 0.973 | 55 | 22000 | 104 | 0.037 | 129 | 1.85 |
| 11 | 11 | 8.0 | 0.972 | 54 | 22000 | 105 | 0.036 | 131 | 1.90 |
| 12 | 12 | 7.9 | 0.973 | 55 | 22000 | 98 | 0.042 | 122 | 2.00 |
| 13 | 13 | 8.0 | 0.972 | 54 | 22000 | 97 | 0.045 | 120 | 2.00 |
| 14 | 14 | 8.0 | 0.974 | 55 | 22000 | 96 | 0.050 | 124 | 3.00 |
| 15 | 15 | 8.9 | 0.972 | 54 | 22000 | 95 | 0.052 | 123 | 3.10 |
| 16 | 16 | 8.1 | 0.973 | 54 | 23000 | 106 | 0.030 | 128 | 0.31 |
| 17 | 17 | 8.0 | 0.970 | 55 | 23000 | 107 | 0.031 | 129 | 0.27 |
| 18 | 18 | 8.0 | 0.975 | 55 | 22000 | 109 | 0.029 | 128 | 0.25 |
| 19 | 19 | 8.1 | 0.973 | 54 | 23000 | 110 | 0.028 | 129 | 0.25 |
| 20 | 20 | 8.0 | 0.977 | 54 | 23000 | 110 | 0.026 | 127 | 0.23 |

TABLE 3-1-continued

| Physical properties of toners | | | | | | | | | |
|---|---|---|---|---|---|---|---|---|---|
| Toner No. | 25% area ratio | 50% area ratio | Domain area ratio | Number average diameter of APES domain (μm) | Maximum diameter of domain A (μm) | Maximum diameter of domain B (nm) | SA (%) | SB/SA | Toner THF insolubles (%) |
| 1 | 50 | 91 | 1.22 | 1.00 | 2.3 | 150 | 10 | 0.25 | 22 |
| 2 | 51 | 92 | 1.24 | 0.80 | 2.3 | 200 | 10 | 0.35 | 3 |
| 3 | 52 | 93 | 1.27 | 0.60 | 2.3 | 250 | 10 | 0.40 | 2 |
| 4 | 49 | 92 | 1.14 | 2.00 | 2.3 | 120 | 10 | 0.20 | 48 |
| 5 | 49 | 93 | 1.11 | 2.20 | 2.3 | 100 | 10 | 0.18 | 52 |
| 6 | 51 | 92 | 1.24 | 1.30 | 2.3 | 5 | 10 | 0.11 | 22 |
| 7 | 51 | 93 | 1.21 | 1.40 | 2.3 | 4 | 10 | 0.08 | 22 |
| 8 | 49 | 91 | 1.17 | 0.90 | 2.3 | 450 | 10 | 0.75 | 22 |
| 9 | 49 | 90 | 1.20 | 0.80 | 2.3 | 520 | 10 | 0.80 | 23 |
| 10 | 51 | 91 | 1.28 | 1.10 | 1.1 | 50 | 3 | 0.50 | 24 |
| 11 | 51 | 91 | 1.28 | 1.20 | 0.9 | 60 | 2 | 0.70 | 23 |
| 12 | 51 | 94 | 1.19 | 0.80 | 3.0 | 150 | 13 | 0.20 | 24 |
| 13 | 49 | 94 | 1.09 | 0.70 | 3.1 | 150 | 16 | 0.15 | 21 |
| 14 | 60 | 95 | 1.71 | 1.30 | 2.3 | 150 | 10 | 0.25 | 21 |
| 15 | 62 | 95 | 1.88 | 1.40 | 2.3 | 150 | 10 | 0.25 | 22 |
| 16 | 37 | 82 | 0.82 | 0.90 | 2.4 | 140 | 10 | 0.22 | 22 |
| 17 | 32 | 80 | 0.67 | 0.90 | 2.4 | 130 | 10 | 0.21 | 22 |
| 18 | 30 | 80 | 0.60 | 0.60 | 2.5 | 130 | 11 | 0.20 | 23 |
| 19 | 30 | 77 | 0.64 | 0.80 | 2.5 | 130 | 11 | 0.20 | 24 |
| 20 | 28 | 78 | 0.56 | 0.30 | 2.5 | 130 | 11 | 0.20 | 23 |

TABLE 3-2

Table 3-2. Physical properties of toners

| Toner No. | Toner base particles No. | D4 of toner (μm) | Average circularity | Tg of toner (° C.) | Peak molecular weight of toner particle (Mp) | Temperature T (° C.) | Slope of area increasing rate | Toner softening point (° C.) | S211/S85 | 25% area ratio | 50% area ratio | Domain area ratio | Number average diameter of APES domain (μm) | Maximum diameter of domain A (μm) | Maximum diameter of domain B (nm) | SA (%) | SB/SA | Toner THF insolubles (%) |
|---|---|---|---|---|---|---|---|---|---|---|---|---|---|---|---|---|---|---|
| 21 | 21 | 8.0 | 0.975 | 54 | 23000 | 95 | 0.056 | 126 | 3.50 | 70 | 97 | 2.59 | 2.20 | 2.3 | 150 | 10 | 0.25 | 21 |
| 22 | 22 | 8.1 | 0.973 | 55 | 23000 | 93 | 0.060 | 126 | 4.00 | 74 | 98 | 3.08 | 3.00 | 3.1 | 4 | 16 | 0.06 | 21 |
| 23 | 23 | 8.0 | 0.972 | 54 | 22000 | 108 | 0.038 | 128 | 1.90 | 45 | 88 | 1.05 | 3.00 | 2.4 | 140 | 11 | 0.24 | 23 |
| 24 | 24 | 8.0 | 0.973 | 55 | 23000 | 94 | 0.065 | 126 | 2.90 | 65 | 94 | 2.24 | 0.60 | 2.3 | 150 | 10 | 0.25 | 18 |
| 25 | 25 | 7.9 | 0.974 | 55 | 21000 | 92 | 0.068 | 125 | 3.00 | 68 | 95 | 2.52 | 0.70 | 2.3 | 150 | 10 | 0.25 | 22 |
| 26 | 26 | 7.8 | 0.972 | 55 | 23000 | 99 | 0.045 | 125 | 2.40 | 68 | 95 | 2.52 | 2.50 | 2.3 | 150 | 10 | 0.25 | 20 |
| 27 | 27 | 8.1 | 0.974 | 55 | 22000 | 98 | 0.048 | 125 | 2.80 | 72 | 96 | 3.00 | 2.90 | 2.2 | 150 | 9 | 0.27 | 20 |
| 28 | 28 | 8.0 | 0.972 | 55 | 30000 | 107 | 0.040 | 140 | 2.50 | 50 | 90 | 1.25 | 2.00 | 2.3 | 150 | 10 | 0.25 | 35 |
| 29 | 29 | 8.2 | 0.973 | 54 | 20000 | 100 | 0.065 | 110 | 1.60 | 45 | 92 | 0.96 | 0.60 | 2.8 | 150 | 10 | 0.20 | 17 |
| 30 | 30 | 7.9 | 0.971 | 55 | 20000 | 98 | 0.069 | 124 | 2.00 | 50 | 93 | 1.16 | 0.60 | 2.3 | 150 | 10 | 0.25 | 22 |
| 31 | 31 | 7.8 | 0.970 | 55 | 20000 | 93 | 0.070 | 110 | 2.00 | 51 | 94 | 1.19 | 0.40 | 2.3 | 150 | 10 | 0.25 | 10 |
| 32 | 32 | 7.9 | 0.971 | 54 | 32000 | 110 | 0.035 | 140 | 2.00 | 51 | 85 | 1.50 | 2.30 | 2.3 | 150 | 10 | 0.25 | 40 |
| 33 | 33 | 8.0 | 0.970 | 54 | 22000 | 99 | 0.045 | 125 | 1.50 | 45 | 89 | 1.02 | 1.00 | 2.3 | 150 | 10 | 0.25 | 20 |
| 34 | 34 | 8.1 | 0.971 | 55 | 22000 | 104 | 0.035 | 125 | 1.20 | 30 | 77 | 0.64 | 0.80 | 2.5 | 130 | 11 | 0.20 | 20 |
| 35 | 35 | 8.2 | 0.974 | 54 | 22000 | 94 | 0.060 | 125 | 2.50 | 60 | 92 | 1.88 | 2.00 | 2.2 | 150 | 10 | 0.26 | 20 |
| 36 | 36 | 8.0 | 0.972 | 54 | 34000 | 112 | 0.030 | 142 | 1.50 | 45 | 87 | 1.07 | 2.00 | 2.3 | 150 | 10 | 0.25 | 48 |
| 37 | 37 | 8.1 | 0.974 | 53 | 19000 | 91 | 0.070 | 108 | 2.50 | 60 | 95 | 1.71 | 0.80 | 3.5 | 150 | 20 | 0.25 | 5 |
| 38 | 38 | 8.0 | 0.972 | 52 | 19000 | 90 | 0.088 | 106 | 2.70 | 62 | 96 | 1.82 | 0.80 | 3.5 | 150 | 20 | 0.25 | 2 |
| 39 | 39 | 8.1 | 0.975 | 55 | 22000 | 115 | 0.040 | 120 | 4.50 | — | — | — | — | 2.6 | — | 10 | 0.00 | 20 |
| 40 | 40 | 7.9 | 0.949 | 55 | 24000 | 100 | 0.071 | 109 | 3.80 | 38 | 75 | 1.03 | 0.20 | — | 200 | — | — | 5 |

TABLE 4-1

| | | Normal-temperature and normal-humidity environment | | Normal-temperature and high-humidity environment | | Normal-temperature and normal-humidity environment | Low-temperature and low-humidity environment Fogging on drum after black | | | |
|---|---|---|---|---|---|---|---|---|---|---|
| | Toner | Lower limit temperature at which white spots did not occur | Peel strength of image in which white spots did not occur | Lower limit temperature at which white spots did not occur | Peel strength of image in which white spots did not occur | Density unevenness | 2000 Prints | | 4000 Prints | |
| Example 1 | Toner 1 | A | A | A | A | A | 1.5 | A | 3.0 | A |
| Example 2 | Toner 2 | A | A | A | A | A | 2.1 | A | 6.0 | B |
| Example 3 | Toner 3 | A | A | A | A | B | 2.4 | A | 6.3 | B |
| Example 4 | Toner 4 | A | B | B | A | A | 1.3 | A | 2.5 | A |
| Example 5 | Toner 5 | B | B | C | A | A | 1.2 | A | 2.5 | A |
| Example 6 | Toner 6 | B | A | B | B | A | 1.4 | A | 2.9 | A |
| Example 7 | Toner 7 | C | A | C | B | A | 1.4 | A | 2.8 | A |
| Example 8 | Toner 8 | A | A | A | A | A | 4.4 | A | 8.5 | B |
| Example 9 | Toner 9 | A | A | A | A | A | 5.0 | B | 9.4 | B |
| Example 10 | Toner 10 | B | B | C | A | A | 1.1 | A | 2.6 | A |
| Example 11 | Toner 11 | C | A | C | B | A | 1.1 | A | 2.5 | A |
| Example 12 | Toner 12 | A | A | A | A | A | 4.0 | A | 6.5 | B |
| Example 13 | Toner 13 | A | A | A | A | A | 5.5 | B | 8.5 | B |
| Example 14 | Toner 14 | A | A | A | A | A | 4.4 | A | 8.4 | B |
| Example 15 | Toner 15 | A | A | A | A | A | 6.2 | B | 9.4 | B |
| Example 16 | Toner 16 | A | B | B | A | A | 1.1 | A | 2.5 | A |
| Example 17 | Toner 17 | B | A | B | B | A | 1.0 | A | 2.4 | A |
| Example 18 | Toner 18 | B | B | C | A | A | 1.0 | A | 2.3 | A |
| Example 19 | Toner 19 | C | A | C | B | A | 1.0 | A | 2.2 | A |
| Example 20 | Toner 20 | C | B | C | B | A | 1.0 | A | 2.0 | A |

TABLE 4-2

| | | Normal-temperature and normal-humidity environment | | Normal-temperature and high-humidity environment | | Normal-temperature and normal-humidity environment | Low-temperature and low-humidity environment Fogging on drum after black | | | |
|---|---|---|---|---|---|---|---|---|---|---|
| | Toner | Lower limit temperature at which white spots did not occur | Peel strength of image in which white spots did not occur | Lower limit temperature at which white spots did not occur | Peel strength of image in which white spots did not occur | Density unevenness | 2000 Prints | | 4000 Prints | |
| Example 21 | Toner 21 | A | A | A | A | B | 6.3 | B | 9.4 | B |
| Example 22 | Toner 22 | A | A | A | A | B | 7.0 | B | 11.6 | C |
| Example 23 | Toner 23 | B | B | C | A | A | 1.4 | A | 2.8 | A |
| Example 24 | Toner 24 | A | A | A | A | B | 5.0 | B | 8.0 | B |
| Example 25 | Toner 25 | A | A | A | A | B | 6.0 | B | 9.4 | B |
| Example 26 | Toner 26 | A | A | A | A | A | 4.3 | A | 6.7 | B |
| Example 27 | Toner 27 | A | A | A | A | A | 5.1 | B | 8.2 | B |
| Example 28 | Toner 28 | B | B | C | A | A | 1.1 | A | 2.0 | A |
| Example 29 | Toner 29 | A | A | A | A | B | 7.2 | B | 12.0 | C |
| Example 30 | Toner 30 | A | A | A | A | B | 6.4 | B | 10.5 | C |
| Example 31 | Toner 31 | A | A | A | A | C | 10.0 | C | 14.4 | C |
| Example 32 | Toner 32 | C | A | C | B | A | 1.0 | A | 2.0 | A |
| Example 33 | Toner 33 | A | A | A | A | A | 1.5 | A | 3.0 | A |
| Example 34 | Toner 34 | B | A | B | B | A | 1.4 | A | 2.4 | A |
| Example 35 | Toner 35 | A | A | A | A | B | 4.5 | A | 7.0 | B |
| Comparative Example 1 | Toner 36 | D(200) | — | D(205) | D | A | 1.0 | A | 2.0 | A |
| Comparative Example 2 | Toner 37 | A | A | A | A | D | 15.0 | C | 20.0 | D |
| Comparative Example 3 | Toner 38 | A | A | A | A | D | 20.5 | D | 25.5 | D |
| Comparative Example 4 | Toner 39 | D(205) | — | D(210) | D | A | 1.6 | A | 3.2 | A |
| Comparative Example 5 | Toner 40 | A | A | B | A | D | 15.5 | C | 22.0 | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-130213, filed Jun. 30, 2016, which is hereby incorporated by reference herein in its entirety.

What is claimed is:

1. A toner comprising toner particles each of which includes a binder resin, an amorphous polyester, and a colorant, wherein the binder resin includes a vinyl resin, the toner has a softening point of 110° C. to 140° C., an amount of the amorphous polyester is 4.0 to 30.0 parts by mass with respect to 100 parts by mass of the binder resin, an amount of tetrahydrofuran insolubles in a resin component of the toner is 3 to 50% by mass with respect to the resin component, and when observing the toner which is sandwiched with a pair of cover glasses while heating the cover glasses from 40° C. to 160° C. at a temperature increasing rate of 1.5° C/sec. and defining an area of one of the toner particles at the temperature of 40° C. as 1, a temperature T at which an area increasing rate becomes 1.40 is not more than 110° C., and a slope of the area increasing rate with respect to a temperature in the range of the area increasing rate of 1.40 to 2.00 is not more than 0.07.

2. The toner according to claim 1, wherein the amount of the amorphous polyester is 5.0 to 30.0 parts by mass with respect to 100 parts by mass of the binder resin, the amorphous polyester includes a monomer unit derived from an alcohol component and a monomer unit derived from a straight-chain aliphatic dicarboxylic acid having 6 to 12 carbon atoms, and the monomer unit derived from a straight-chain aliphatic dicarboxylic acid having 6 to 12 carbon atoms is contained in 10 mol% to 50 mol% with respect to all monomer units derived from carboxylic acids which constitute the amorphous polyester.

3. The toner according to claim 1, wherein formula (1) is satisfied when a peak intensity derived from the vinyl resin which is obtained by time-of-flight secondary ion mass spectrometry is defined as S85 and a peak intensity derived from the amorphous polyester is defined as S211

$$0.30 \leq S211/S85 \leq 3.00 \quad (1).$$

4. The toner according to claim 1, wherein in a cross section of the toner particle observed with a transmission electron microscope, the vinyl resin forms a matrix, and the amorphous polyester forms domains, and a proportion of the domains of the amorphous polyester present in a region within 25% of a distance between an outline of the cross section and a center point of the cross section from the outline is 30 to 70% by area with reference to a total area of the domains of the amorphous polyester.

5. The toner according to claim 1, wherein in a cross section of the toner particle observed with a transmission electron microscope, the vinyl resin forms a matrix, and the amorphous polyester forms domains, and a proportion of the domains of the amorphous polyester present in a region within 50% of a distance between an outline of the cross section and a center point of the cross section from the outline is 80 to 100% by area with reference to a total area of the domains of the amorphous polyester.

6. The toner according to claim 1, wherein in a cross section of the toner particle observed with a transmission electron microscope, the vinyl resin forms a matrix, and the amorphous polyester forms domains, and when an area of the domains of the amorphous polyester present in a region within 25% of a distance between an outline of the cross section and a center point of the cross section from the outline is defined as A and an area of the domains of the amorphous polyester present within 25% to 50% of the distance between the outline of the cross section and the center point of the cross section from the outline is defined as B, a ratio (AB) of A to B is at least 1.05.

7. The toner according to claim 1, wherein in a cross section of the toner particle observed with a transmission electron microscope, the vinyl resin forms a matrix, and the amorphous polyester forms domains, and a number average diameter of the domains of the amorphous polyester is 0. 3 to 3.0 μm.

8. The toner according to claim 1, wherein an acid value of the amorphous polyester is 1.0 to 10.0 mg KOH/g.

9. The toner according to claim 1, wherein the toner includes a release agent, in a cross section of the toner particle observed with a transmission electron microscope (i) a domain A of the release agent with a maximum diameter of 1.0 to 3.0 μm; and (ii) a domain B of the release agent with a maximum diameter of 5 to 500 nm are present, and when a proportion of an area occupied by the domain A in the toner particle cross section is defined as SA and a proportion of an area occupied by the domain B is defined as SB, formulas (2) and (3) are satisfied $$3\% \text{ by area} \leq SA \leq 30\% \text{ by area} \quad (2)$$

$$0.1 \leq SB/SA \leq 0.8 \quad (3).$$

10. A developing device comprising:

a toner for developing an electrostatic latent image formed on an electrostatic latent image bearing member; and a toner carrying member that carries the toner and transports the toner to the electrostatic latent image bearing member, wherein the toner has a toner particle including a binder resin, an amorphous polyester, and a colorant, the binder resin includes a vinyl resin, the toner has a softening point of 110° C. to 140° C., an amount of the amorphous polyester is 4.0 to 30.0 parts by mass with respect to 100 parts by mass of the binder resin, an amount of tetrahydrofuran insolubles in a resin component of the toner is 3 to 50% by mass with respect to the resin component, and when sandwiching the toner between cover glasses, putting the cover glasses which have sandwiched the toner on a heating stage, observing the toner from above while heating the cover glasses which have sandwiched the toner from 40° C. to 160° C. at a rate of 1.5° C/sec. and defining an area S(40) of the one toner particle sample at 40° C. as 1, a temperature T at which an area increasing rate of one toner particle sample becomes 1.40 is not more than 110° C., and a slope of the area increasing rate with respect to a temperature in the range of the area increasing rate of 1.40 to 2.00 is not more than 0.07.

11. An image forming apparatus comprising:

an electrostatic latent image bearing member;

a charging member that charges the electrostatic latent image bearing member;

a toner for developing an electrostatic latent image formed on the electrostatic latent image bearing member; and a toner carrying member that comes into contact with the electrostatic latent image bearing member and transports the toner, the toner which remains on the electrostatic latent image bearing member after a transfer being collected by the toner carrying member, wherein the toner has a toner particle including a binder resin, an amorphous polyester, and a colorant, the binder resin includes a vinyl resin, the toner has a softening point of 110° C. to 140° C., an amount of the amorphous polyester is 4.0 to 30.0 parts by mass with respect to 100 parts by mass of the binder resin, an amount of tetrahydrofuran insolubles in a resin component of the toner is 3 to 50% by mass with respect to the resin component, and when sandwiching the toner between cover glasses, putting the cover glasses which have sandwiched the toner on a heating stage, observing the toner from above while heating the cover glasses which have sandwiched the toner from 40° C. to 160° C. at a rate of 1.5° C/sec. and defining an area S(40) of the one toner particle sample at 40° C. as 1, a temperature T at which an area increasing rate of one toner particle sample becomes 1.40 is not more than 110° C., and a slope of the area increasing rate with respect to a temperature in the range of the area increasing rate of 1.40 to 2.00 is not more than 0.07.

12. A toner comprising a release agent and toner particles, each of which includes a binder resin, an amorphous polyester and a colorant, wherein the binder resin includes a vinyl resin, the toner has a softening point of 110° C. to 140° C., an amount of the amorphous polyester is 4.0 to 30.0 parts by mass with respect to 100 parts by mass of the binder resin, and when observing the toner which is sandwiched with a pair of cover glasses while heating the cover glasses from 40° C. to 160° C. at a temperature increasing rate of 1.5° C/sec. and defining an area of one of the toner particles at the temperature of 40° C. as 1, a temperature T at which an area increasing rate becomes 1.40 is not more than 110° C., and a slope of the area increasing rate with respect to a temperature in the range of the area increasing rate of 1.40 to 2.00 is not more than 0.07, and in a cross section of the toner particle observed with a transmission electron microscope (i) a domain A of the release agent with a maximum diameter of 1.0 to 3.0 μm; and (ii) a domain B of the release agent with a maximum diameter of 5 to 500 nm are present, and when a proportion of an area occupied by the domain A in the toner particle cross section is defined as SA and a proportion of an area occupied by the domain B is defined as SB, formulas (2) and (3) are satisfied $$3\% \text{ by area} \leq SA \leq 30\% \text{ by area} \quad (2)$$

$$0.1 \leq SB/SA \leq 0.8 \quad (3).$$

* * * * *